US010118750B2

(12) United States Patent
Al-Housseiny

(10) Patent No.: US 10,118,750 B2
(45) Date of Patent: Nov. 6, 2018

(54) POURING DEVICE FOR A CONTAINER WITH AN INNER BAG AND METHOD OF USING SAME

(71) Applicant: Talal T. Al-Housseiny, Princeton, NJ (US)

(72) Inventor: Talal T. Al-Housseiny, Princeton, NJ (US)

( * ) Notice: Subject to any disclaimer, the term of this patent is extended or adjusted under 35 U.S.C. 154(b) by 0 days.

(21) Appl. No.: 15/251,393

(22) Filed: Aug. 30, 2016

(65) Prior Publication Data

US 2018/0057238 A1 Mar. 1, 2018

(51) Int. Cl.
*B65D 77/06* (2006.01)
*B65D 47/06* (2006.01)

(52) U.S. Cl.
CPC ..... *B65D 77/065* (2013.01); *B65D 47/06* (2013.01); *B65D 77/068* (2013.01)

(58) Field of Classification Search
CPC ..... B65D 5/746–5/749; B65D 47/06; B65D 77/065; B65D 77/068; B65D 83/06; B65D 77/067
USPC ..... 222/569; 229/125.04
See application file for complete search history.

(56) References Cited

U.S. PATENT DOCUMENTS 1,847,028 A 2/1932 Townsend
2,311,255 A * 2/1943 Read ..... B65D 5/746 222/531
2,593,778 A 4/1952 McGinnis
2,851,212 A 9/1958 Parmer
2,877,932 A * 3/1959 Whitmire ..... B65D 5/746 222/536
3,108,732 A 10/1963 Curie et al.
3,184,117 A 5/1965 Sanderson
3,233,817 A 2/1966 Casady
(Continued)

FOREIGN PATENT DOCUMENTS

EP 0359968 3/1990
GB 349139 A 2/1964

OTHER PUBLICATIONS

International Search Report and Written Opinion dated Nov. 3, 2017; International Application No. PCT/US17/49314; International Filing Date Aug. 30, 2017; 14 pages.
(Continued)

*Primary Examiner* — J. Casimer Jacyna
(74) *Attorney, Agent, or Firm* — Blank Rome LLP; Matthew J. Esserman

(57) ABSTRACT

A pouring device for pouring material from an inner bag placed within a container and method of using same are disclosed. The pouring device is movable between open and closed configurations. An embodiment provides a pouring device that includes a main body and at least one mounting part. The main body includes at least two walls and at least one attachment part, which is attached to the inner bag. The walls extend angularly away from each other to form a conduit allowing material to flow from the inner bag through an opening of the container to an exterior of the container, when the pouring device is in the open configuration. Embodiments foster a pouring solution with the mounting part conveniently mounted to the container and which remains mounted when the container is stowed. This allows the pouring device to be ready for future use.

87 Claims, 20 Drawing Sheets

(56) References Cited

U.S. PATENT DOCUMENTS

| | | | | | |
|---|---|---|---|---|---|
| 3,896,979 | A * | 7/1975 | Pehr | B65D 5/746 | 222/528 |
| 4,951,850 | A * | 8/1990 | Clayton | B65D 5/746 | 222/535 |
| 5,014,888 | A * | 5/1991 | Bryan | B65D 5/744 | 222/541.5 |
| 6,062,467 | A * | 5/2000 | Ours | B65D 5/744 | 229/117.3 |
| 6,145,736 | A * | 11/2000 | Ours | B65D 5/744 | 229/117.3 |
| 6,206,571 | B1 | 3/2001 | Olin | | |
| 6,227,440 | B1 | 5/2001 | Hart | | |
| 6,296,388 | B1 | 10/2001 | Galomb et al. | | |
| 6,474,040 | B1 * | 11/2002 | Ours | B65B 61/186 | 229/117.3 |
| 9,315,311 | B2 | 4/2016 | Hutchison et al. | | |
| 2004/0074955 | A1 * | 4/2004 | McKenna | B65D 5/746 | 229/125.08 |
| 2004/0114838 | A1 | 6/2004 | McGregor | | |
| 2004/0208402 | A1 | 10/2004 | Yeager | | |
| 2006/0285781 | A1 | 12/2006 | Zoss | | |
| 2008/0285897 | A1 | 11/2008 | Taheri | | |
| 2010/0142858 | A1 | 6/2010 | Kruse et al. | | |
| 2016/0096657 | A1 | 4/2016 | Satkiewicz | | |

OTHER PUBLICATIONS

English Abstract; European Application No. EP0359968; Publication Date: Mar. 28, 1990; 1 page.

* cited by examiner

POURING DEVICE FOR A CONTAINER WITH AN INNER BAG AND METHOD OF USING SAME

FIELD OF THE INVENTION

Embodiments are in the field of pouring devices. More particularly, embodiments disclosed herein relate to pouring devices for pouring material from a bag placed within a container and methods of using same which, inter alia, foster a pouring solution that is attached to the inner bag and may be easily mounted to the container. The pouring device may have a closure mechanism to preserve the material. This pouring solution allows a user to stow the container with the pouring device mounted, thereby making the pouring device ready for future use.

BACKGROUND OF THE INVENTION

Pouring a material stored within an inner bag, which is placed within a container, and controlling the flow of the material often presents challenges. In particular, a user must go through at least two layers to get to the stored material: opening the container, then opening the inner bag. The process can be even more laborious if a user rolls, folds, and/or clips the inner bag inside the container when pouring is completed to preserve the material within the inner bag. In addition, once open, the inner bag requires careful handling to control the flow of material being poured. Furthermore, it is highly likely that, initially, a user tears/opens the sealed inner bag inappropriately, or at least not optimally. Such scenario makes it increasingly difficult to control the flow of material from the inner bag. As an example, pouring a material (e.g., cereal) from an inner bag (e.g., flexible plastic bag) placed within a container (e.g., a carton) can be an inconvenient process and can also lead to material spills and waste, which require clean-up of the surrounding area.

To address these inconveniences, to improve user experience, and to control material flow, a number of pouring systems (e.g., pourers, pouring solutions, spouts, lips, conduits, etc.) have been proposed. These known pouring systems are typically part of or attach to an inner bag. A common problem with these known pouring systems is that they are not mounted or mountable to the container, thereby making them unready for use. To pour material, a user must first open the container to get to the inner bag. Moreover, careful handling of the inner bag may still be required with these known pouring systems in order to control the flow of material being poured.

Thus, it is desirable to provide a pouring device for pouring material from an inner bag placed within a container and method of using same that are able to overcome the above disadvantages.

Advantages of the present invention will become more fully apparent from the detailed description of the invention hereinbelow.

SUMMARY OF THE INVENTION

Embodiments are directed to a pouring device for pouring material from an inner bag placed within a container to an exterior of the container via an opening of the container, the pouring device being movable between a closed configuration and an open configuration different from the closed configuration. The pouring device comprises a main body which comprises at least two walls. A plurality of the at least two walls are not substantially planar with respect to each other, when the pouring device is in the open configuration. The at least two walls extend angularly away from each other so that the at least two walls form a conduit therebetween, when the pouring device is in the open configuration, thereby allowing the material from the inner bag to flow through the conduit to the exterior of the container via the opening of the container. The main body also comprises at least one attachment part connected to the at least two walls. At least a portion of each attachment part is configured to be attached to a portion of the inner bag via an attachment mechanism, when the pouring device is in the open and closed configurations. The pouring device also comprises at least one mounting part connected to the main body. At least a portion of each mounting part is configured to be attached to a portion of the container via at least one mounting mechanism or to be placed against the portion of the container, when the pouring device is in the open configuration.

Embodiments are also directed to a method of using a pouring device for pouring material from an inner bag placed within a container to an exterior of the container via an opening of the container, the pouring device being movable between a closed configuration and an open configuration different from the closed configuration. The method comprises providing a pouring device which comprises a main body which comprises at least two walls. A plurality of the at least two walls are not substantially planar with respect to each other, when the pouring device is in the open configuration. The at least two walls extend angularly away from each other so that the at least two walls form a conduit therebetween, when the pouring device is in the open configuration. The main body also comprises at least one attachment part connected to the at least two walls. At least a portion of each attachment part is configured to be attached to a portion of the inner bag via an attachment mechanism, when the pouring device is in the open and closed configurations. The pouring device also comprises at least one mounting part connected to the main body. The method also comprises attaching at least a portion of each mounting part to a portion of the container via at least one mounting mechanism or placing the at least a portion of each mounting part against the portion of the container, when the pouring device is in the open configuration. The material from the inner bag is allowed to flow through the conduit to the exterior of the container via the opening of the container, when the pouring device is in the open configuration.

Additional embodiments and additional features of embodiments for the pouring device and method of using the pouring device are described below and are hereby incorporated into this section.

BRIEF DESCRIPTION OF THE DRAWINGS

The detailed description will refer to the following drawings, wherein like reference numerals refer to like elements, and wherein.

DETAILED DESCRIPTION OF THE INVENTION

Figure 1B:
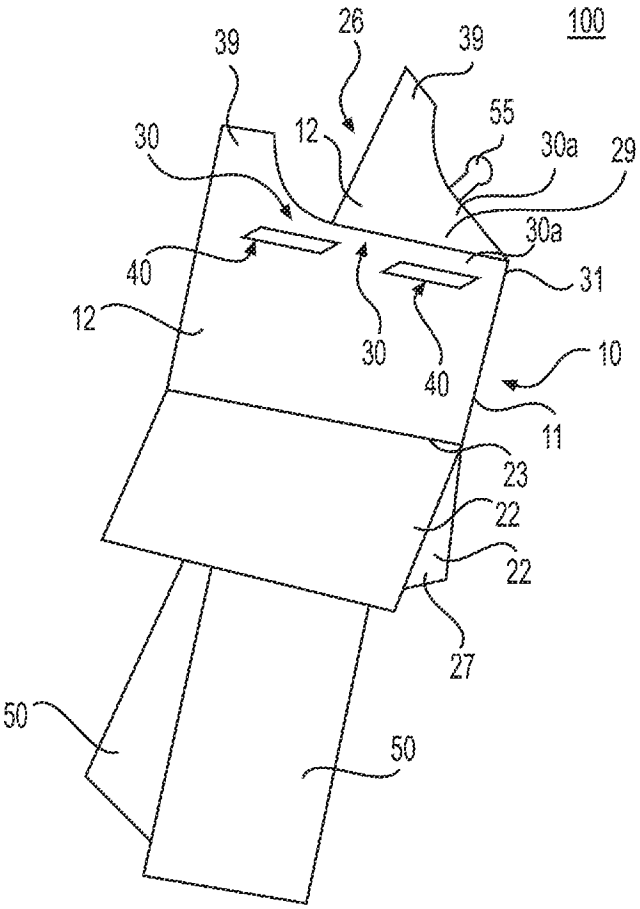
FIG. 1B is a diagram illustrating a perspective view of the pouring device shown in FIG. 1A, wherein the pouring device is in an open configuration.

It is to be understood that the figures and descriptions of the present invention may have been simplified to illustrate elements that are relevant for a clear understanding of the present invention, while eliminating, for purposes of clarity, other elements found in a typical pouring device for pouring material from a container or typical method of using a pouring device for pouring material from a container. Those of ordinary skill in the art will recognize that other elements may be desirable and/or required in order to implement the present invention. However, because such elements are well known in the art, and because they do not facilitate a better understanding of the present invention, a discussion of such elements is not provided herein. It is also to be understood that the drawings included herewith only provide diagrammatic representations of the presently preferred structures of the present invention and that structures falling within the scope of the present invention may include structures different than those shown in the drawings. Reference will now be made to the drawings wherein like structures are provided with like reference designations.

For purposes of this disclosure, the term "planar" refers to an element or combination of elements that may have any thickness, and having sides defining the thickness that are parallel with each other.

Embodiments are directed to a pouring device for pouring material from an inner bag placed within a container, the pouring device being movable between a closed configuration and an open configuration different from the closed configuration. The pouring device is a foldable, bendable, movable, and/or optionally removable device that may be attached to an inner bag (e.g., by a user, distributor, or added by a worker or machine at a manufacturing facility) and may be mounted (e.g., by a user) to a container that houses the inner bag.

Portions or all of the pouring device may comprise a suitable material that allows for folding/bending/collapsing/moving of the walls and/or attachment portion such as cardboard, paperboard, paper, wood, plastic, elastomers (e.g., rubber, silicone, etc.), metal, polymers (e.g., polyurethane, etc.), or combinations thereof. The material may be chosen for reusability of the pouring device, or, alternatively, the material may be chosen based on a disposable (i.e., one-time or limited use only) variation.

Inner Bag

The inner bag may be any type (e.g., plastic bag, paper bag, package, liner, etc.) that contains a pourable material such as solids (e.g., cereal, snacks, nuts, raisins, pellets, grains, powder, etc.), liquids (e.g., beverages, wine, chemicals, detergent, etc.), or combinations thereof (e.g., slurry solution, suspensions, etc.). The inner bag may be flexible, semi-rigid, or rigid. As examples, the inner bag may be flexible (and may be distortable) such as a cereal bag, or may be rigid such as a liner. The size, shape, dimensions, weight, and composition of the inner bag may vary since, for example, the at least one attachment part (mentioned below) may be configured accordingly. Examples of flexible material suitable for the inner bag include paperboard, paper, plastic, etc. The inner bag may be sealable to preserve the material contained therein, but this is not necessary.

Walls

The size, shape, dimensions, weight, and composition of the at least two walls may vary. For example, the at least two walls may extend out of the container and/or towards the inner bag. The at least two walls may be connected to the at least one attachment part (mentioned below) via an attachment-wall hinge or via another portion of the main body. The at least two walls may be connected via at least one wall hinge, which may be used to move the pouring device from the closed configuration to the open configuration (and/or vice versa). The wall hinge may not be necessary since, for example, the at least one attachment part (mentioned below), the at least one lip part, and/or the at least one extension part may comprise portions thereof which may be connected via at least one attachment hinge, at least one lip hinge, and/or at least one extension hinge, respectively, as mentioned below.

Any or all of the at least two walls may be planar (e.g., flat, straight, etc.). Alternatively, any or all of the at least two walls may be non-planar and may comprise, for example, one or more curved (or other shape) walls, surfaces, or portions (e.g., natural curved shapes, bending shapes under stress, surfaces rigidly connected, surfaces connected by hinges, facets, or combinations thereof, etc.) The shape of the least two walls may be uniform (e.g., uniform thickness). Alternatively, the shape of the at least two walls may be non-uniform (e.g., varying thickness, discontinuities such as holes, grooves, ridges, slits, combination thereof, etc.)

Attachment Part

The size, shape, dimensions, weight, and composition of the at least one attachment part may vary since, for example, the at least one attachment part may be configured based on the composition, the shape, and/or the flexibility of the inner bag. The at least one attachment part may be integral with or a different material than the corresponding wall adjacent thereto and/or the optional at least one extension part (mentioned below). The at least one attachment part may extend toward and/or along the seal area of the inner bag. The at least one attachment part may comprise a plurality of attachment portions, which may be connected by at least one attachment hinge. The at least one attachment part may be directly adjacent to the corresponding wall adjacent thereto, or there may be at least one element positioned between the at least one attachment part and the corresponding wall adjacent thereto. For instance, the at least one attachment part may be connected to one of the at least two walls by an attachment-wall hinge.

Figure 1A:
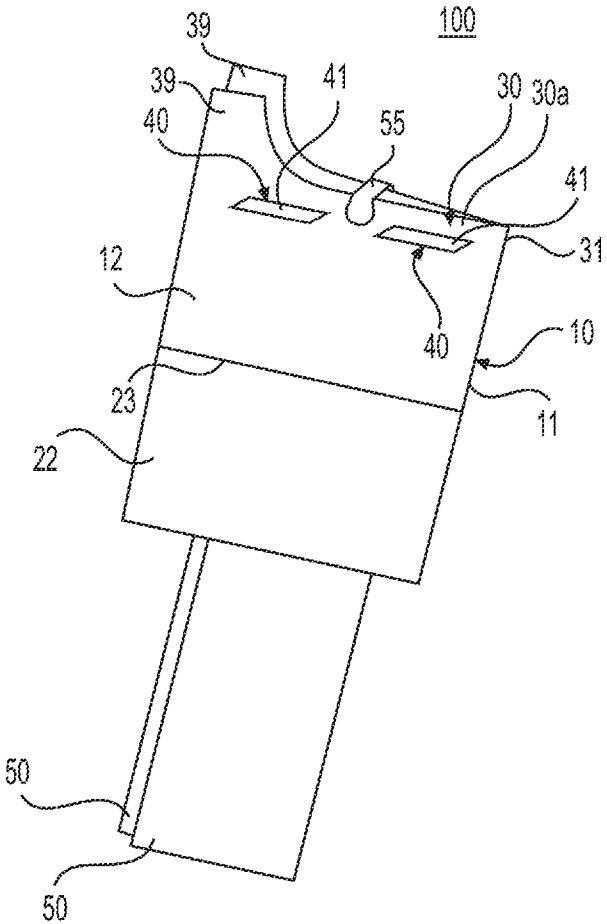
FIG. 1A is a diagram illustrating a perspective view of an embodiment of a pouring device for pouring material from an inner bag placed within a container. The pouring device is in a substantially closed configuration and includes at least one mounting part and a main body. The main body includes at least two walls and at least one attachment part.

The location where the at least one attachment part attaches to the inner bag varies (e.g., at a middle portion of the inner bag; FIGS. 2C, 2D) and, alternatively, the location may or may not be at or near an edge or corner of the inner bag. The at least one attachment part may be any number of unconnected portions (e.g., FIGS. 1A, 1B) or connected portions. At least a portion of each attachment part is configured to be attached to a portion of the inner bag via an attachment mechanism. The attachment mechanism may be permanent or releasable, and may comprise any mechanism type for attachment such as chemical (e.g., adhesive, glue, epoxy, polymer), magnetic (e.g., magnetic tape), mechanical (e.g., clips, interlock/interconnection), thermal bonding (e.g., melting plastic), hook and loop fastener, adhesive tape, friction-fit, etc. The at least one attachment device may be attached to the inner bag by a user (e.g., when the pouring device is sold with a cereal box) and may be releasably attached (e.g., via clips, releasable adhesive, etc.) or permanently attached (e.g., via bonding, adhesive, etc.). Alternatively, the releasably or permanent attachment of the at least one attachment device to the inner bag may be performed at any stage during the value chain (e.g., manufacturing facility, filling facility, packaging facility, distribution facility, etc.). For example, the attachment may occur before or after filling material within the inner bag, or after initial manufacturing of the inner bag.

At least one portion of the pouring device (including the at least one attachment part) may be manufactured as part of the inner bag (i.e., integral to the material of the inner bag). This optionally may occur when the inner bag and the at least one portion of the pouring device intended to be the point of attachment share a similar material (e.g., if both elements are composed of paperboard). This optional integral manufacturing technique may also be employed to facilitate later attachment of pouring device. The attachment mechanism may be added to the at least one attachment part and/or portion of the inner bag at the time of or before attachment of the pouring device. Optionally, the at least one attachment part itself may be the attachment mechanism (i.e., no attachment mechanism separate from the at least one attachment part is required).

Container

The container may be any type (e.g., cereal box, rice carton, snack box, wine box, cardboard box, packaging container, can, jar, etc.). The container may be flexible, semi-rigid, or rigid. The size, shape, dimensions, weight, and composition of the container may vary since the at least one mounting part (mentioned below) may be configured accordingly. A suitable container is any container that can have an inner bag placed within its volume. Examples of the container may be, for instance, a carton, box (e.g., plastic, paperboard, metal, etc.), package (e.g., plastic, cardboard, wood, metal, etc.), can, jar, etc. The container may comprise portions (e.g., ridges, grooves, etc.) that facilitate later mounting and usage of the pouring device.

Opening

The opening in the container may be already made in the container (e.g., before a user purchases the container) or may be made by the user after purchase of the container. The size, shape, dimensions, and composition of opening may vary (e.g., the opening may be an entire side of the container (e.g., an upper missing or torn side of the container). The location of the opening may vary and may be positioned, for example, at an upper wall of container, side wall of container, etc.). The opening does not require accommodating the pouring device when the pouring device is in an open configuration (e.g., if the at least mounting part (mentioned below) is mounted to an exterior surface of the container at a location which is distant from edges of the opening). The opening may allow passage of the pouring device or portions thereof. However, the opening does not require allowing the pouring device or a portion thereof to pass through (e.g., if the pouring device is mounted to an interior surface portion of container via the at least one mounting part).

Mounting Part

The size, shape, dimensions, weight, and composition of the at least one mounting part may vary since, for example, the at least one mounting part may be configured based on the type of container composition, the shape of the opening of the container, and/or the thickness of the surface(s) surrounding the opening. The at least one mounting part may be connected to any one or more of various portions of the main body of the pouring device. For example, the at least one mounting part may be connected to the at least one attachment part, or to at least one of the two walls. Furthermore, the at least one mounting part may be flush with a surface of the main body.

For example, the at least one mounting part may be a slit in the at least two walls, which interconnects with a portion of a surface of the container. The position of the at least one mounting part with respect to the main body may depend on the distance between the opening of the container and the location of intended attachment of the main body (via the at least one attachment part) to the inner bag. The location where the at least one mounting part is mounted to the container may vary (e.g., the mounting location of the at least one mounting part may be determined according to the desired distance of the mounting location from the opening of the container). The at least one mounting part may be a number of unconnected portions (e.g., FIGS. 1A, 1B) or connected portions. At least a portion of the at least one mounting part may be already mounted (permanently or releasably) to the container prior to usage of the pouring device by a user (e.g., before the user purchases the container/pouring device combination). At least a portion of the at least one mounting part may be manufactured with the container (e.g., by employing at least one carton rib as the at least one mounting part). The at least one mounting part may comprise at least one releasable mounting mechanism which may comprise any type selected from the group consisting of mechanical (e.g., interlock, fastening, strap, hook and loop fastener, etc.), magnetic (e.g. magnetic tape, magnets, etc.), chemical (e.g., bonding, releasable or permanent adhesive, glue, epoxy, etc.), permanent chemical mounting (e.g., permanent adhesive, welding, etc.), permanent mechanical mounting (e.g., irreversible strip fastener, permanent lock, etc.), thermal attachment (e.g., melting plastic), and combinations thereof. At least a portion of the at least one mounting part may protrude above, or may be flush with, an outer surface of the container where the mounting occurs.

Sealing Mechanism

The size, shape, dimensions, and composition of the sealing mechanism may vary since, for example, the type of sealing mechanism may be configured based on the closed configuration of the pouring device. The sealing mechanism may be placed between any two opposing sides of the main body when the pouring device is in the closed configuration. For example, the sealing mechanism may be between the at least two walls, the at least one attachment part, the at least one extension part, or any combination of these (e.g., from a portion of the at least one attachment part to one of the at least two walls). The sealing mechanism may be a resealable sealing mechanism such as a zip-top or press-seal fastener, chemical adhesive, a magnetic mechanism, mechanical interlock, hook and loop fastener, tape, glue, friction-fit fastener, strap, etc.

Closing Mechanism

The size, shape, dimensions, weight, and composition of the closing mechanism may vary since, for example, the shape of the closing mechanism may be configured based on the shape of an exit aperture of the conduit of the pouring device. The closing mechanism may be foldable. The closing mechanism may comprise a plurality of closing portions, which may be connected by a closing hinge (e.g., a foldable lid comprising a closing hinge). A link/connection between the closing mechanism and a remaining/connecting portion of the main body may not be employed (e.g., the closing mechanism may be an independent piece separate from remaining portions of the main body). The link/connection between the closing mechanism and a connecting portion of the main body may be extremely short (e.g., the link/connection may be only a hinge between the closing portion and the connecting portion of the main body). When connected to main body via a link/connection, the closing mechanism may be connected to at least one of various portions of the main body (e.g., the at least two walls, the at least one attachment part, and/or the at least one mounting part). The closing mechanism may unfold as the pouring device is moved from the closed configuration to the open configuration (e.g., when the link/connection to the main body is also foldable). Alternatively, the closing mechanism may unfold in an independent manner. The type of closing mechanism employed may vary and may comprise, for example, a lid, snap cap, snap cap, screw cap, etc.) as long as it substantially closes the conduit when the pouring device is in the open configuration. The closing mechanism may protrude out of the container when applied or may be flush with an external surface of the container when applied (e.g., FIG. 2H). The closing mechanism may provide a substantially good closure to preserve the material in the inner bag. The closing mechanism may comprise a handling portion to be employed by a user (e.g., to facilitate removal of the applied closing mechanism before using the pouring device for pouring material).

Figure 1D:
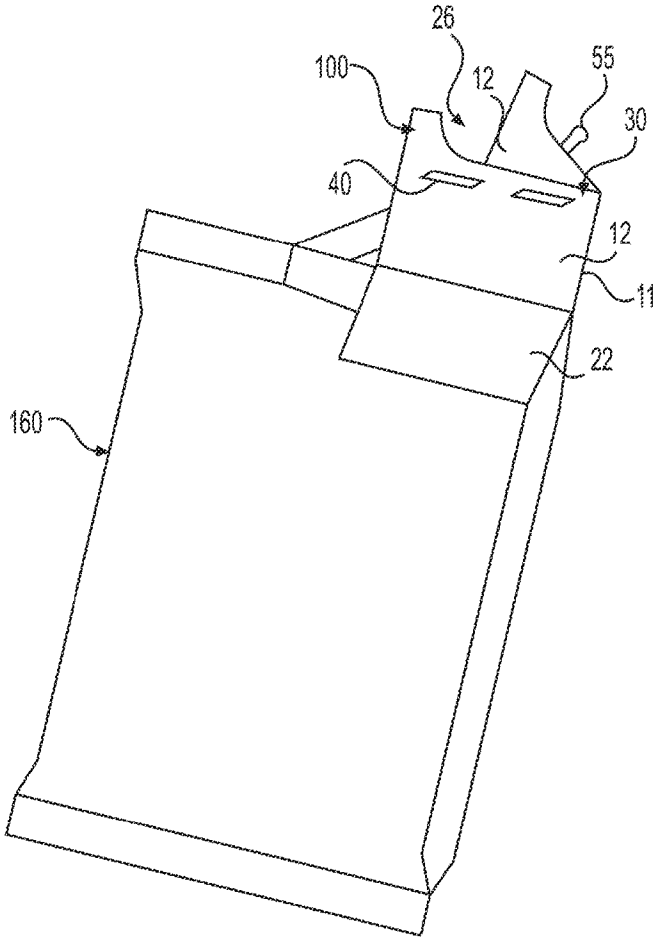
FIG. 1D is a diagram illustrating a perspective view of the pouring device and inner bag shown in FIG. 1C, wherein the pouring device is in an open configuration.
Figure 1C:
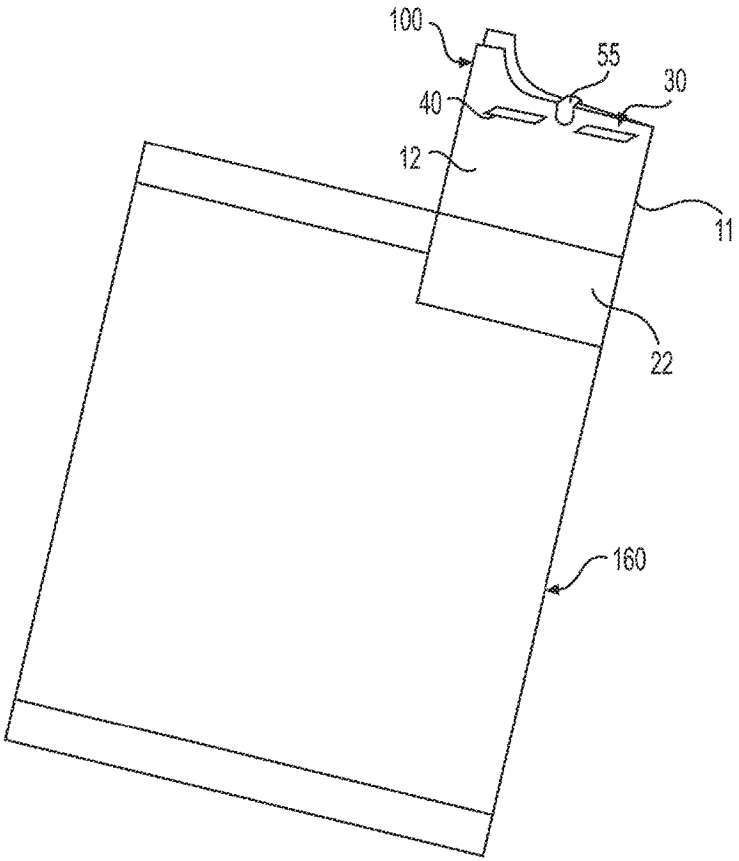
FIG. 1C is a diagram illustrating a perspective view of the pouring device shown in FIG. 1A, wherein the pouring device is in a substantially closed configuration and the at least one attachment part is attached to an exterior surface of an inner bag.
Figure 1E:
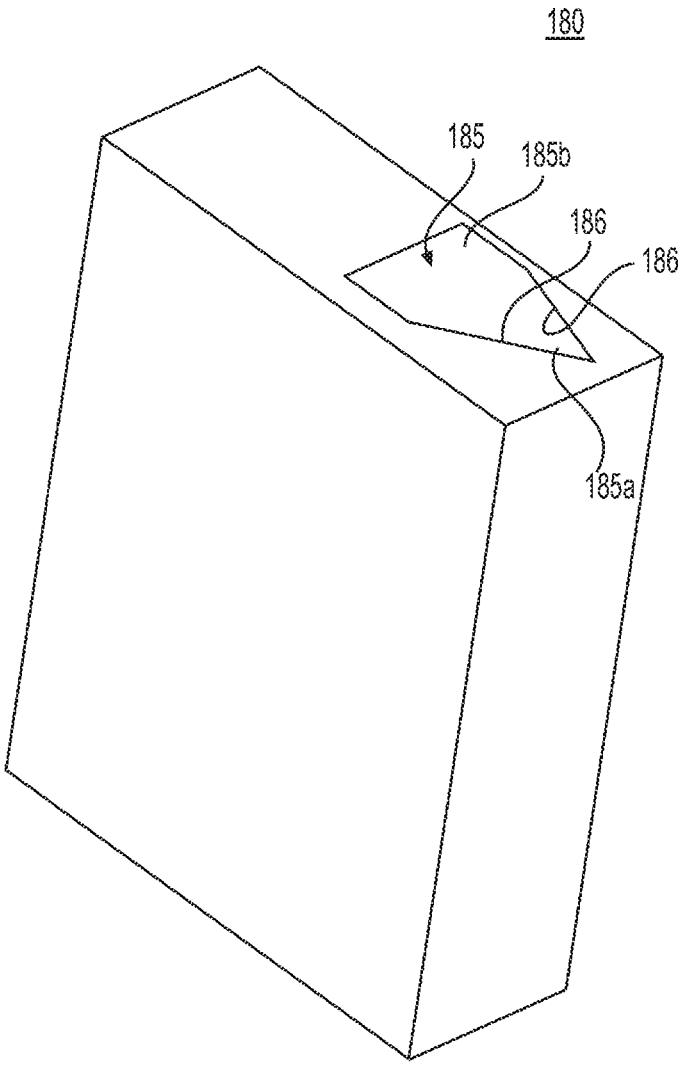
FIG. 1E is a diagram illustrating a perspective view of a container with an opening.
Figure 1G:
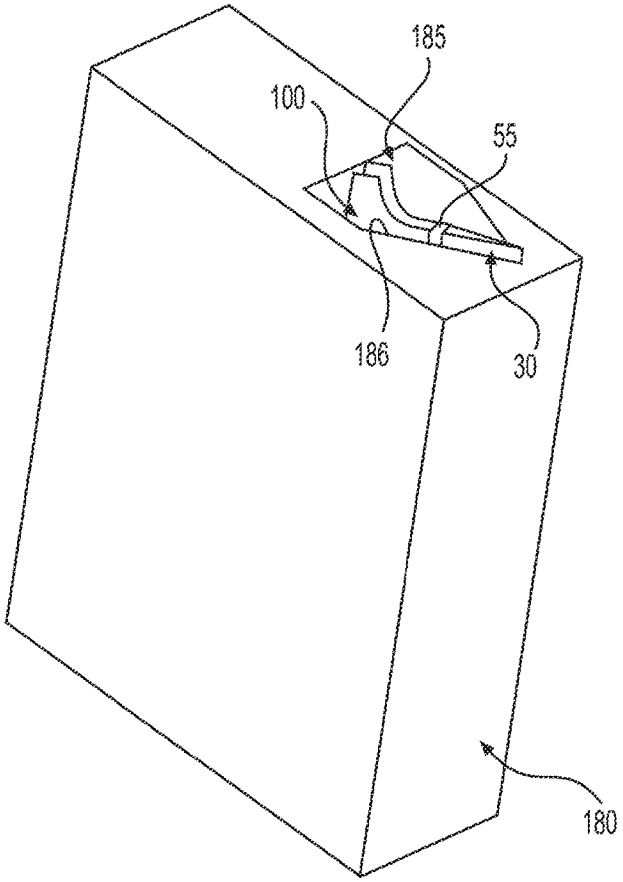
FIG. 1G is a diagram illustrating a perspective view of the pouring device and container shown in FIG. 1F, wherein the pouring device is in a substantially closed configuration utilizing a fastening mechanism, and wherein the at least one mounting part remains partially mounted to an interior surface of the container.
Figure 2A:
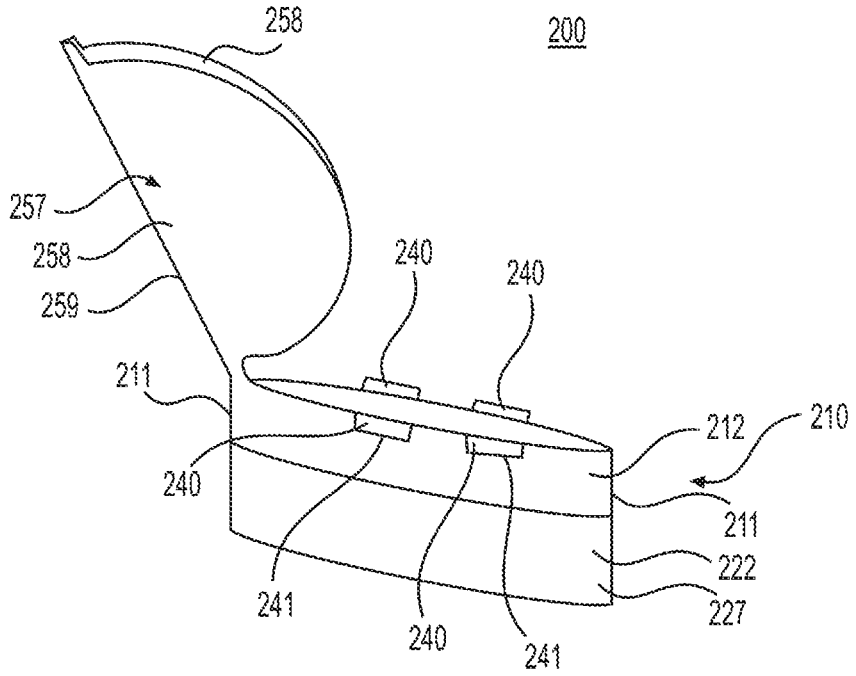
FIG. 2A is a diagram illustrating a perspective view of another embodiment of a pouring device for pouring material from an inner bag placed within a container. The pouring device is in a substantially closed configuration and includes at least one mounting part and a main body. The main body includes at least two walls and at least one attachment part, and a closing mechanism.
Figure 2B:
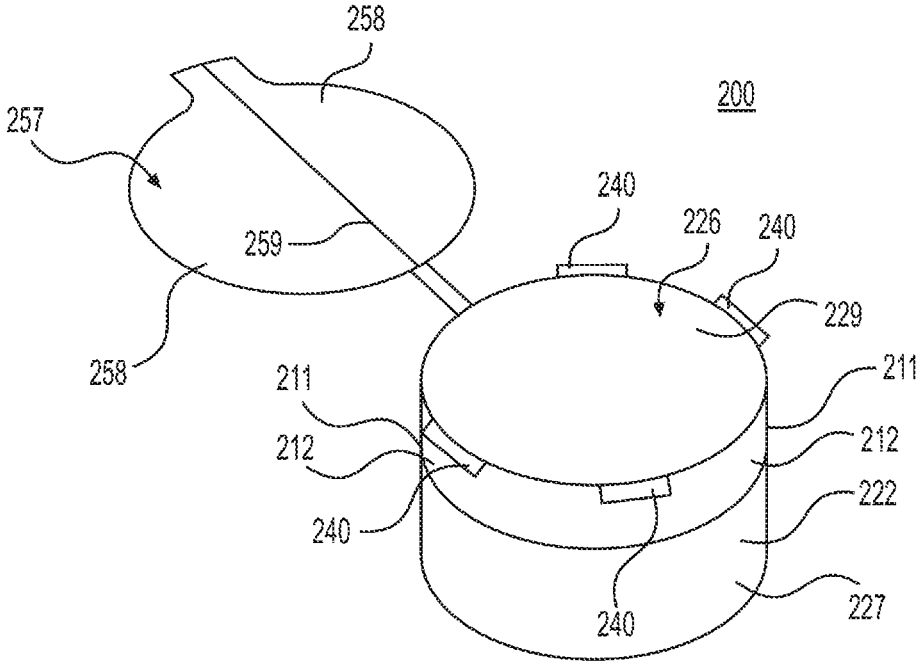
FIG. 2B is a diagram illustrating a perspective view of the pouring device shown in FIG. 2A, wherein the pouring device is in an open configuration and the closing mechanism is unfolded.
Figure 2D:
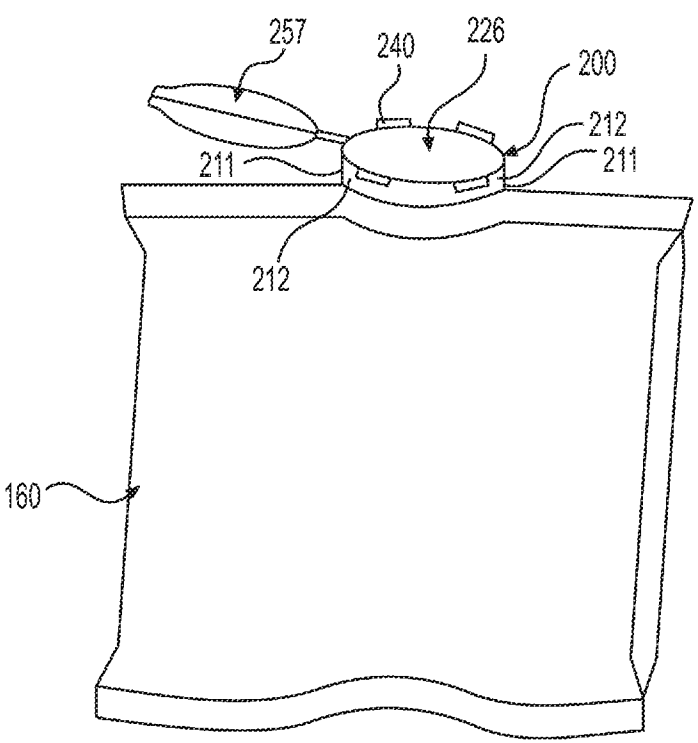
FIG. 2D is a diagram illustrating a perspective view of the pouring device and inner bag shown in FIG. 2C, wherein the pouring device is in an open configuration and the closing mechanism is unfolded.
Figure 2C:
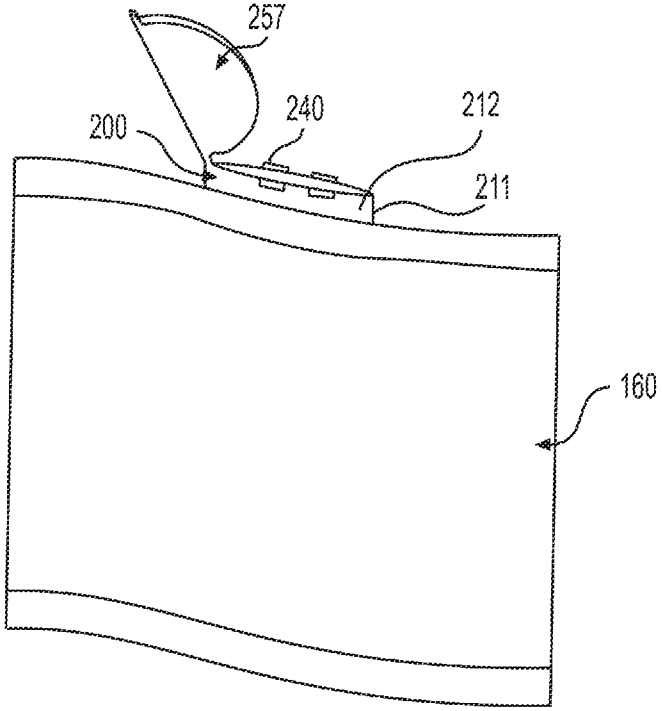
FIG. 2C is a diagram illustrating a perspective view of the pouring device shown in FIG. 2A, wherein the pouring device is in a substantially closed configuration and the at least one attachment part is attached to an interior surface of an inner bag.
Figure 2F:
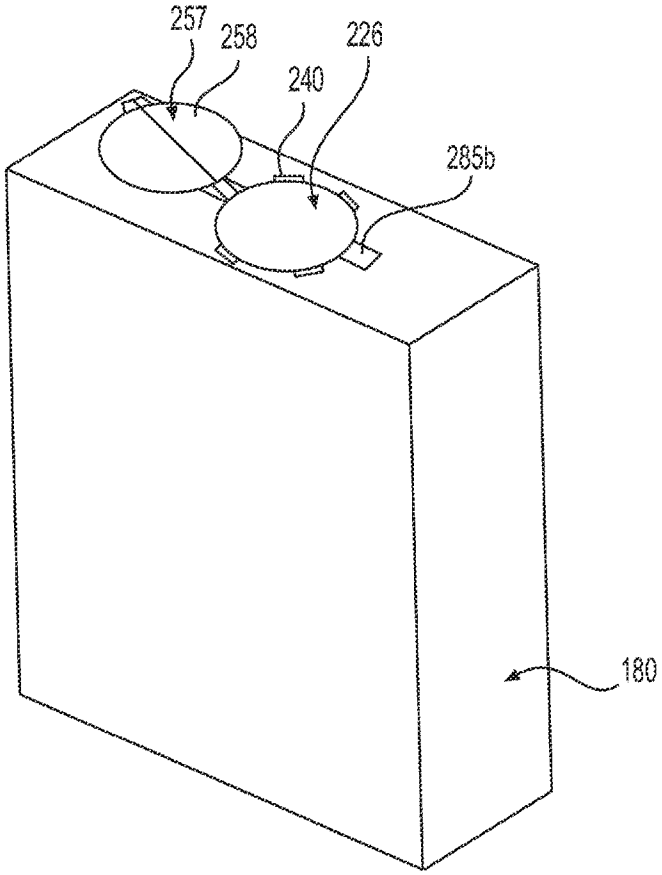
FIG. 2F is a diagram illustrating a perspective view of the pouring device shown in FIG. 2A, wherein the pouring device is in an open configuration, the at least one mounting part is mounted to an exterior surface of the container, and the closing mechanism is unfolded.
Figure 2E:
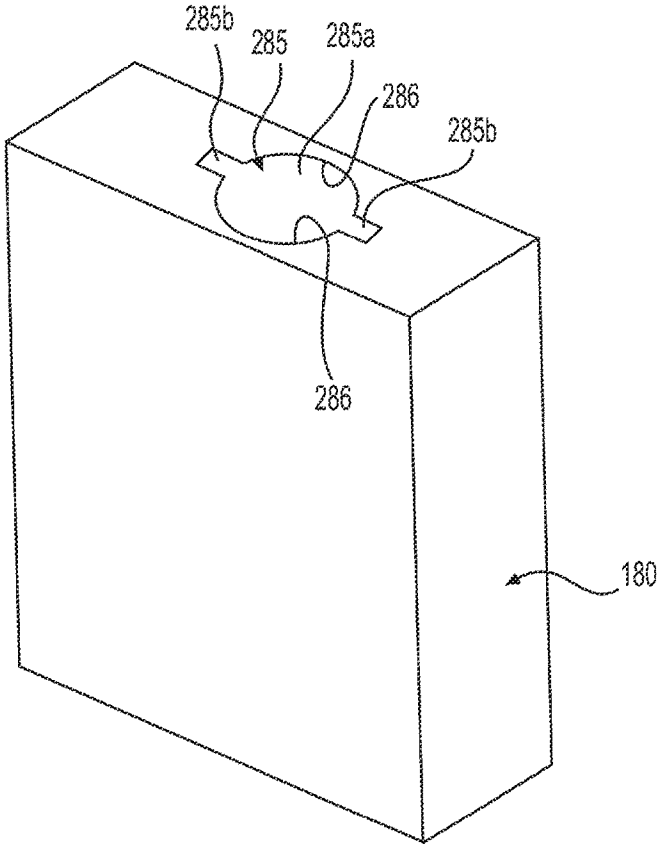
FIG. 2E is a diagram illustrating a perspective view of a container with an opening.
Figure 2H:
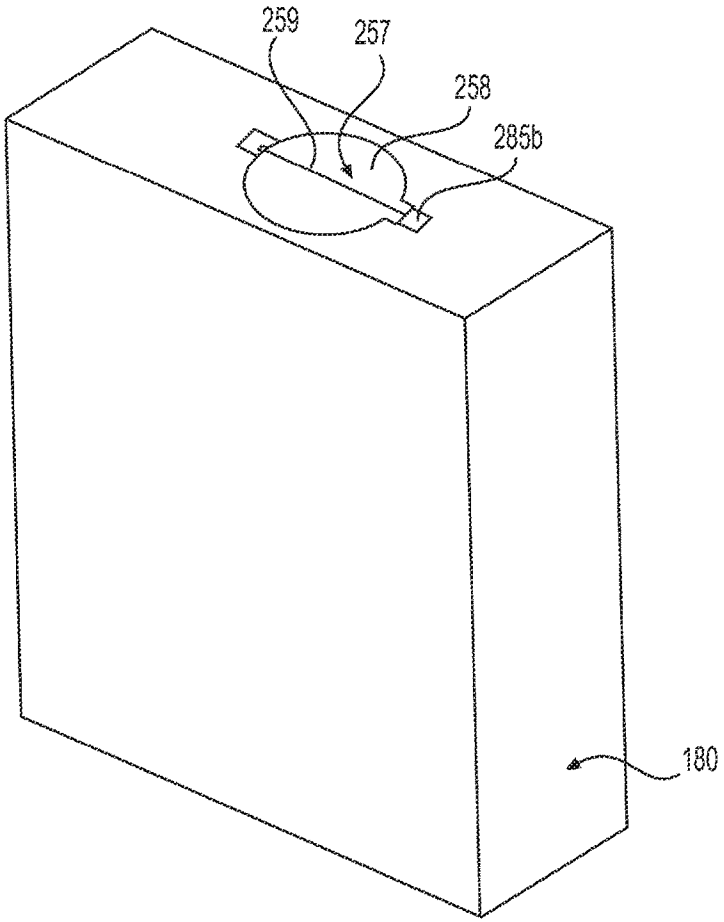
FIG. 2H is a diagram illustrating a perspective view of the pouring device and container shown in FIG. 2F, wherein the unfolded closing mechanism is applied to an exit aperture of the conduit of the pouring device to maintain substantial closure of the conduit, when the pouring device is in an open configuration.
Figure 2G:
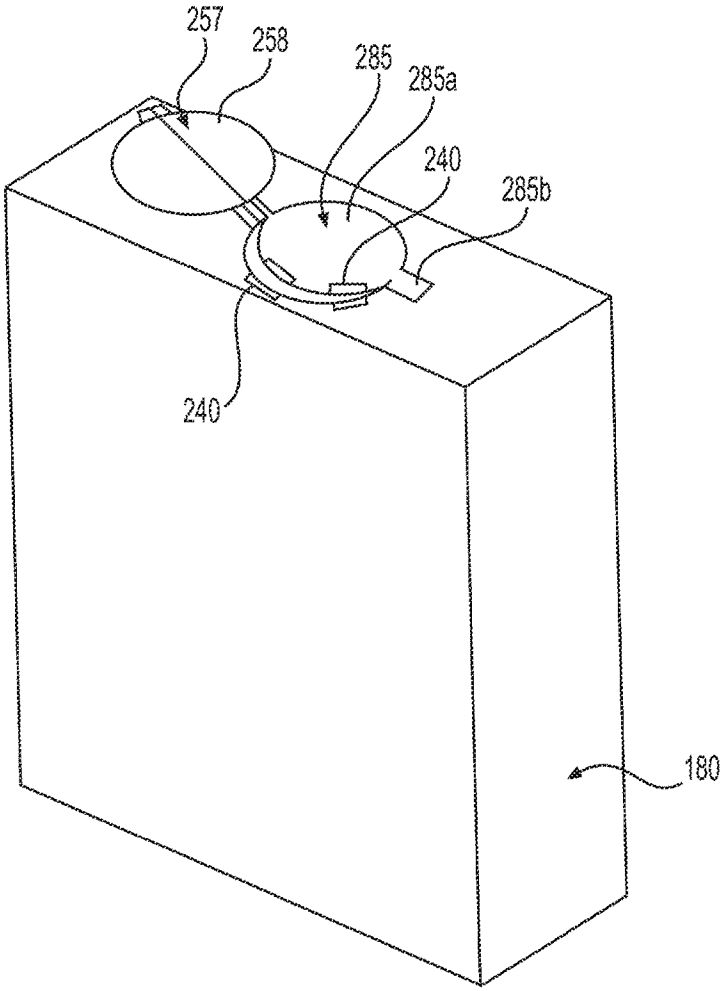
FIG. 2G is a diagram illustrating a perspective view of the pouring device and container shown in FIG. 2F, wherein the pouring device is in a substantially closed configuration, and wherein the at least one mounting part remains partially mounted to an exterior surface of the container.
Figure 3B:
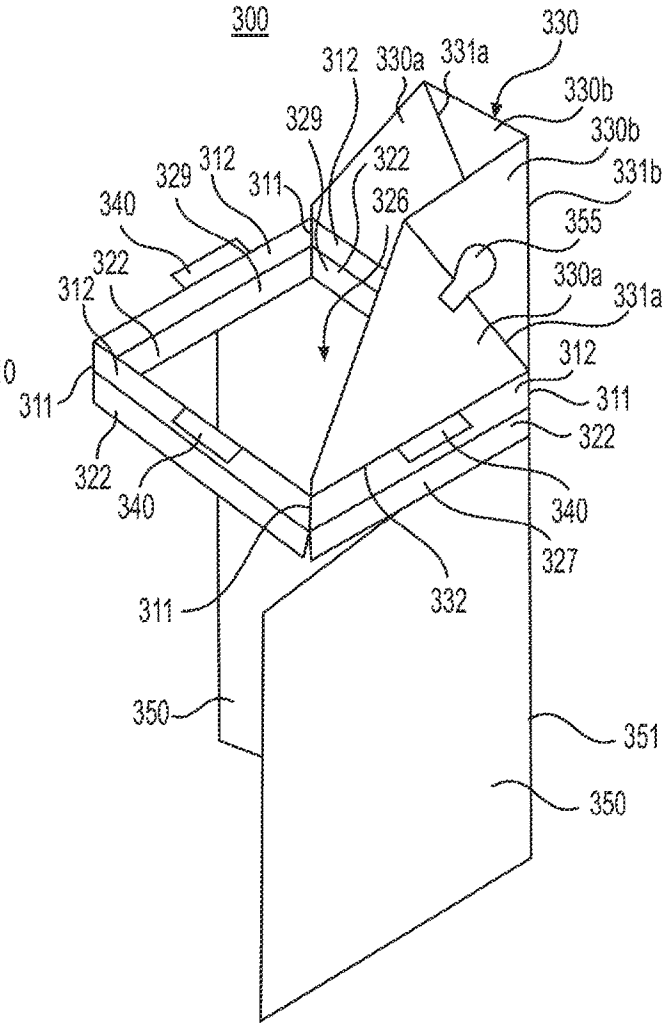
FIG. 3B is a diagram illustrating a perspective view of the pouring device shown in FIG. 3A, wherein the pouring device is in an open configuration and the at least one lip part is in an extended position.
Figure 3A:
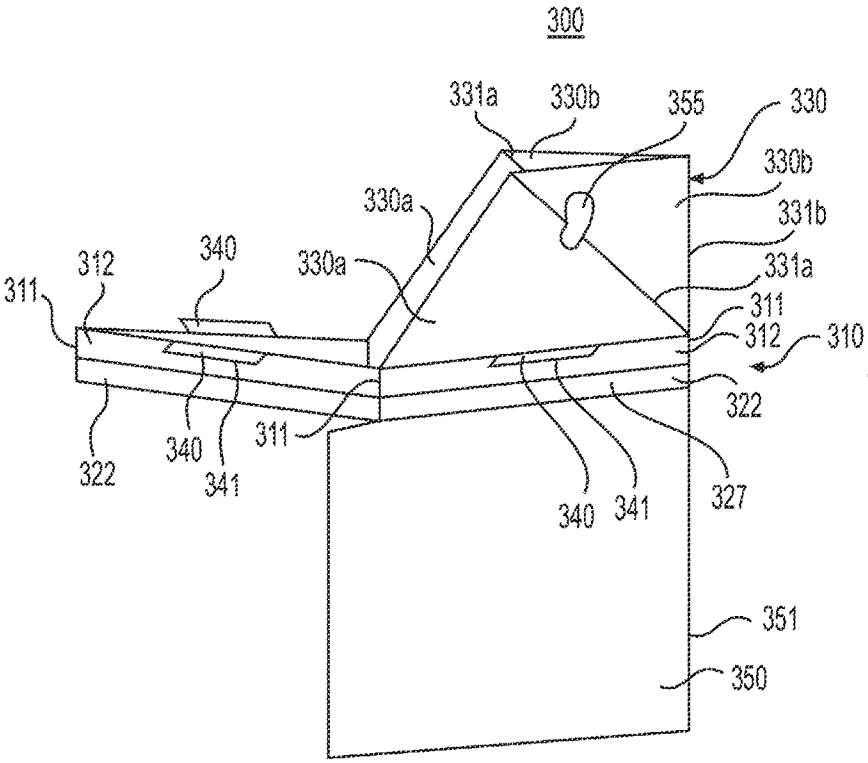
FIG. 3A is a diagram illustrating a perspective view of another embodiment of a pouring device for pouring material from an inner bag placed within a container. The pouring device is in a substantially closed configuration and includes at least one mounting part and a main body. The main body includes at least two walls at least one attachment part, at least one lip part, and at least one extension part.
Figure 3D:
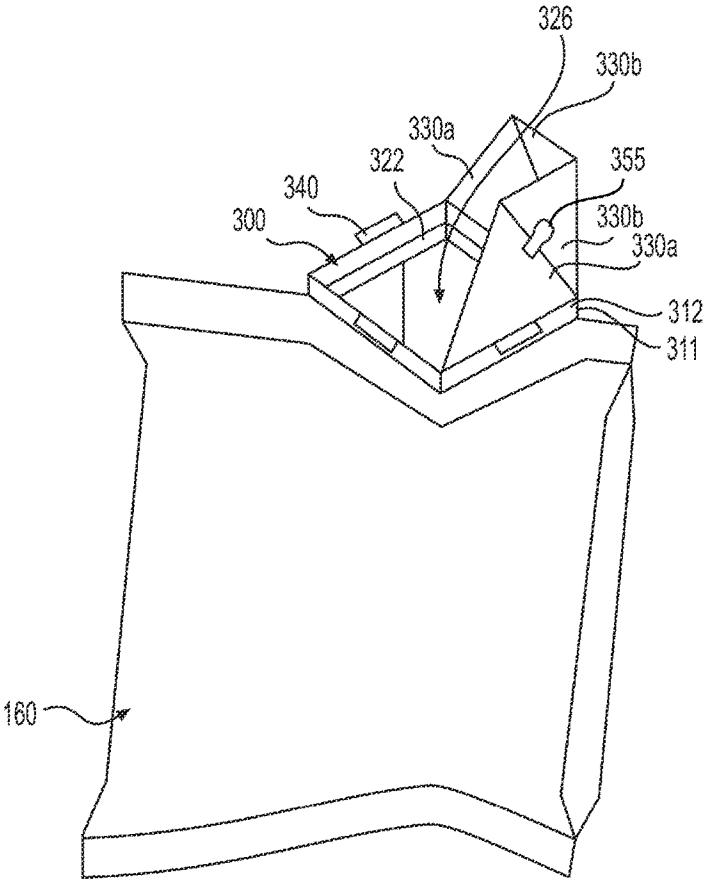
FIG. 3D is a diagram illustrating a perspective view of the pouring device and inner bag shown in FIG. 3C, wherein the pouring device is in an open configuration and the at least one lip part is in an extended position.
Figure 3C:
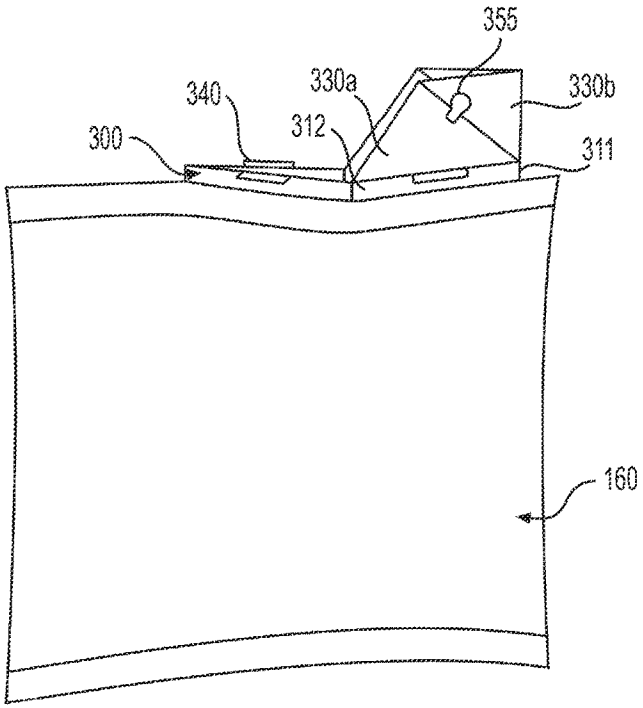
FIG. 3C is a diagram illustrating a perspective view of the pouring device shown in FIG. 3A, wherein the pouring device is in a substantially closed configuration and the at least one attachment part is attached to an interior surface of an inner bag, and wherein the at least one lip part is in an extended position.
Figure 3F:
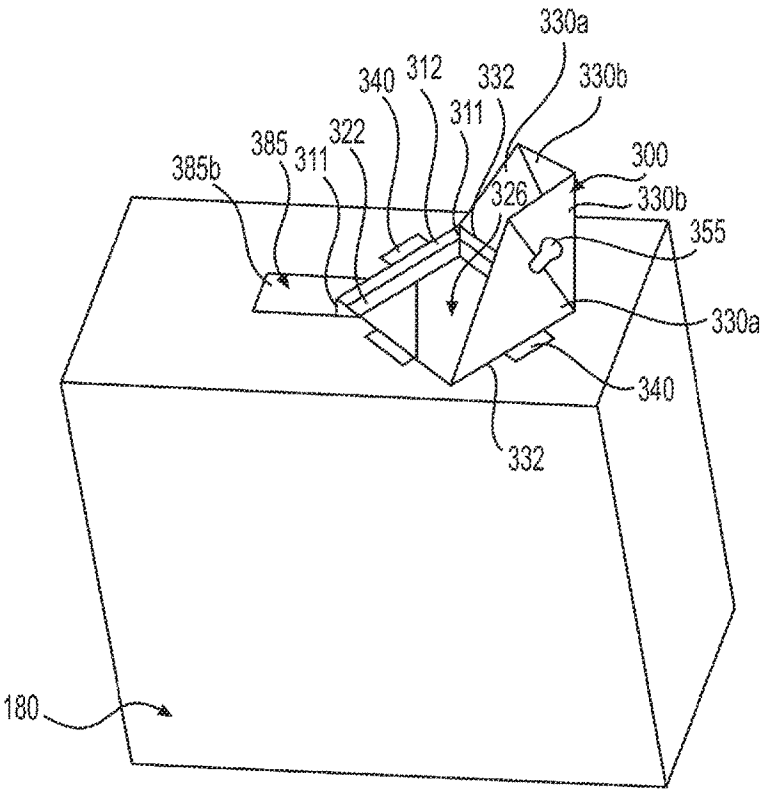
FIG. 3F is a diagram illustrating a perspective view of the pouring device shown in FIG. 3A, wherein the pouring device is in an open configuration and the at least one attachment part is attached to an interior surface of an inner bag, the at least one mounting part is mounted to an exterior surface of the container, and the at least one lip part is in an extended position.
Figure 3E:
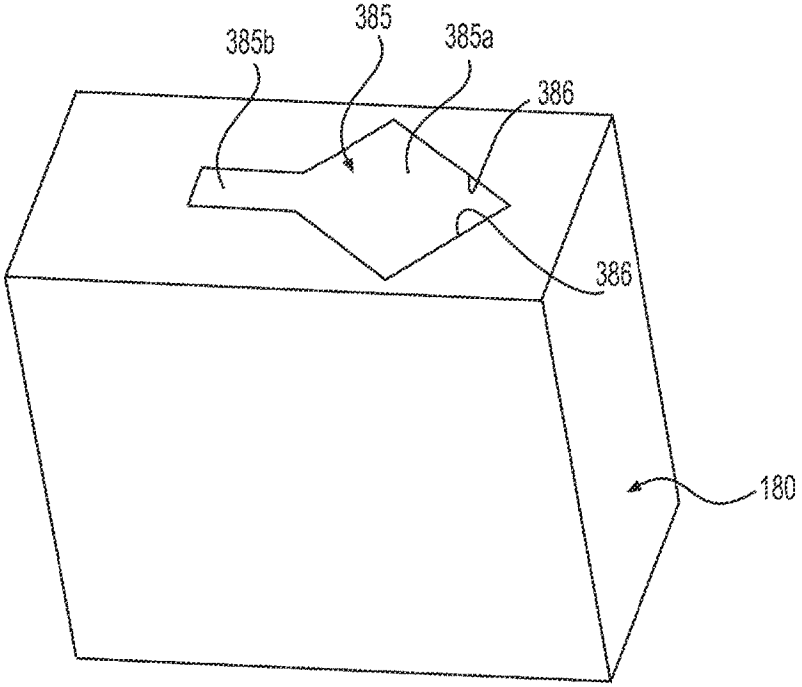
FIG. 3E is a diagram illustrating a perspective view of a container with an opening.
Figure 3H:
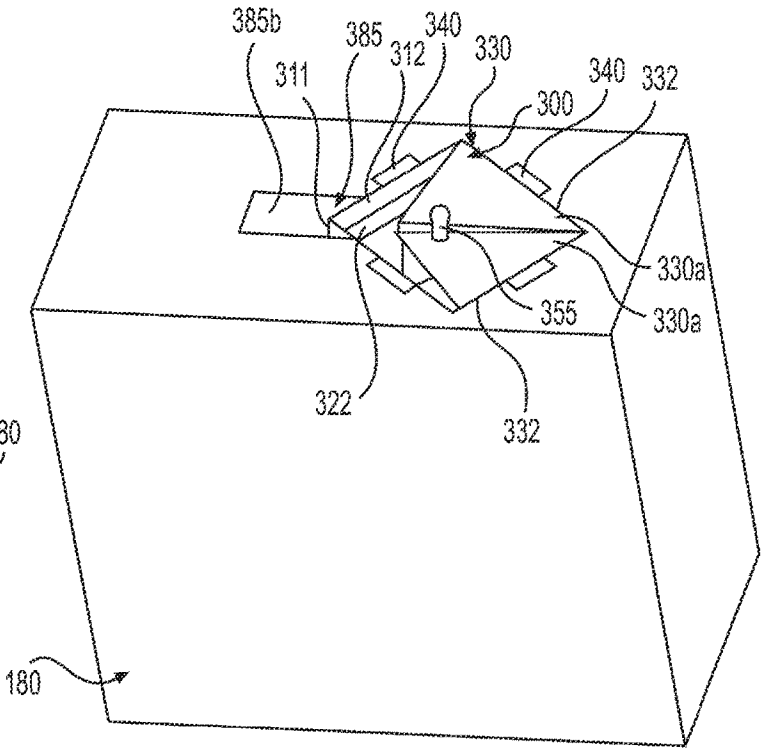
FIG. 3H is a diagram illustrating a perspective view of the pouring device and container shown in FIG. 3F, wherein the at least one lip part is in a retracted position and substantially closes the conduit of the pouring device, when the pouring device is in an open configuration.
Figure 3G:
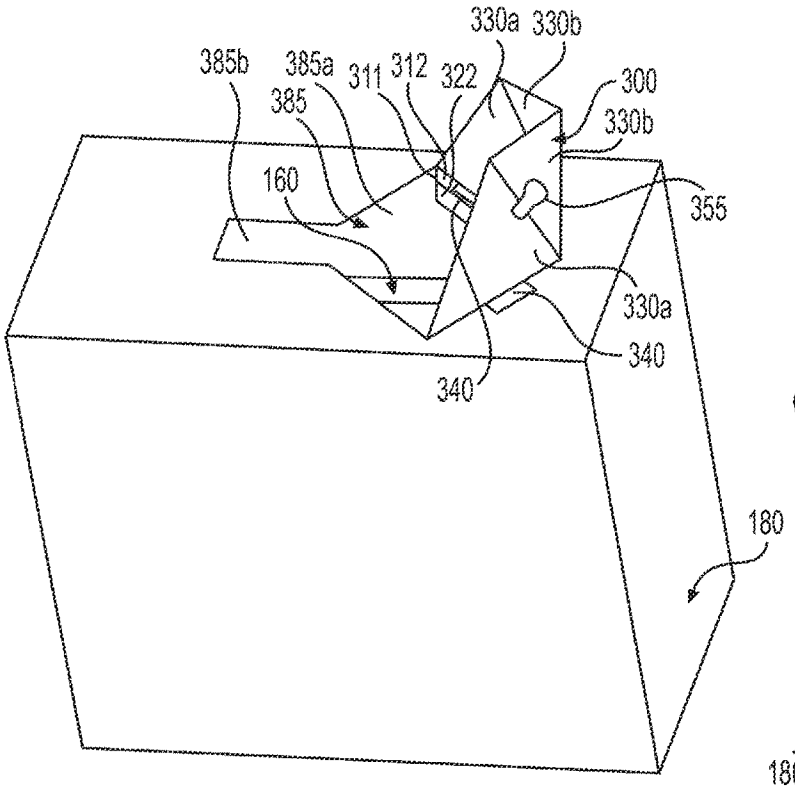
FIG. 3G is a diagram illustrating a perspective view of the pouring device and container shown in FIG. 3F, wherein the pouring device is in a closed configuration, and wherein the at least one mounting part remains partially mounted to an exterior surface of the container.

Alternative or additional closing configurations may have the walls close toward each other differently depending on which embodiment and wall types are employed, how the walls retract angularly towards each other, and/or which walls remain mounted to at least one mounting part (e.g., right wall goes toward left wall as in FIGS. 1G and 2G, anterior walls go toward posterior walls as in FIG. 3G, etc.). In any configuration or embodiment, only a portion of the at least one mounting part may remain mounted. These alternative or additional closing configurations provide a substantially good closure to preserve the material in the inner bag, which may already be sealed using the sealing mechanism in these alternative closing configurations. The at least one mounting part employed for these alternative or additional closing configurations may be the same or different than the at least one mounting part used to mount the pouring device to the container in the open configuration.

Lip Part

The size, shape, dimensions, weight, and composition of the at least one lip part may vary. The at least one lip part may or may not be foldable. For example, no fold may be employed when the at least one lip part is connected to only one wall of the at least two walls. The at least one lip part may be connected to at least one remaining portion of the main body (e.g., to at least one of the at least two walls, the at least one mounting part, and/or the at least one attachment part). The at least one lip part may comprise any number, positions, and dimensions of lip portions (e.g., panels or walls). The lip portions may be connected by at least one lip hinge. The specific design of the lip portions and the at least one lip hinge is dependent on the various objectives to be achieved (e.g., control flow, cooperative with a particular type of closure mechanism, etc.). The panels or walls may fold with respect to each other via lip hinges when the at least one lip part is retracted (e.g., FIG. 3H). Alternatively, the portions (e.g., panels or walls) of the at least one lip part may not fold with respect to each other when the at least one lip part is retracted (e.g., FIG. 4M). When retracted, the at least one lip part may protrude out of container or may be flush with an outer surface of the container (e.g., FIGS. 3H, 4M). A fastening mechanism mentioned in any of the embodiment described herein may optionally be present on the at least one lip part. The at least one lip part may be maintained in a retracted position (e.g., by fastening to an exterior surface of the container, by locking to a slit of the container, or by locking to a slit of another portion of the main body). When retracted, the at least one lip part may provide a substantially good closure to preserve the material in the inner bag. The at least one lip part may be biased to the extended position, to the retracted position, or to both the extended and retracted positions, by, for example, manufacturing the at least one lip part such that it has shape memory or by employing special types of hinges (e.g., binary hinges).

Extension Part

The size, shape, dimensions, weight, and composition of the at least one extension part may vary. The at least one extension part may be flexible, semi-rigid, or rigid. The at least one extension part may be foldable (e.g., FIGS. 3A, 4A), or not foldable (e.g., FIGS. 1A, 1B). The at least one extension part may comprise a number of unconnected portions (e.g., FIGS. 1A, 1B) or connected portions. The at least one extension part may comprise a plurality of extension portions, which may be connected by at least one extension hinge. The at least one extension part may be connected to any one or more of various portions of the main body (e.g., connected to at least one of the at least two walls (e.g., FIG. 1A, 1B), or to at least one attachment part (e.g., FIGS. 2A, 3A, 4A, etc.).

Biasing

To effect biasing for the at least two walls or for the at least one lip part, the pouring device may, for example, be formed with an amount of pre-stress during the manufacturing of the pouring device. Such manufacturing methods capable of providing the pre-stressing or biasing may comprise, for example, thermo-forming, molding, vacuum forming, pressing, creasing, etc. Other biasing mechanisms may include special hinges (e.g., binary hinges). When biasing is provided towards the closed configuration, the pouring device provides resistance when a user moves the pouring device from a closed configuration to an open configuration. When biasing is provided towards the open configuration, the pouring device provides resistance when a user moves the pouring device from an open configuration to a closed configuration.

When the at least one lip part is biased towards an extended configuration, the at least one lip part snaps or pops up toward an extended position when pulled or pushed into an extended configuration by a user. Similarly, when the at least one lip part is biased towards a retracted configuration, the at least one lip part snaps or pops down towards a retracted position when pulled or pushed into a retracted configuration by a user (e.g., such that portions of the at least one lip part are substantially flush with an outer surface of the container).

An Exemplary Method of Using the Pouring Device Illustrated in FIGS. 1A-1G A user tears a section (which may be optionally marked or perforated) of the container to create an opening of the container;

The user pulls out a portion of the pouring device through the opening, when the pouring device is in the closed configuration;

The user removes the cover of an adhesive present on the at least one mounting part to expose the adhesive (the mounting portions are on one of the two walls);

The user mounts the pouring device to an interior surface of the container which is adjacent to the opening;

The user peels the two walls away from each other using optional handling portion(s) extending from anterior portions of the at least one lip part. This action of moving the pouring device from a closed configuration to an open configuration optionally breaks the sealing mechanism connecting the at least two walls, thereby opening the inner bag;

The user manually holds/maintains the open configuration (e.g., the user holds the "loose" wall with a finger or the user fastens the "loose" wall with a fastening mechanism to maintain the open configuration);

The user uses the pouring device to pour material (e.g., into a bowl);

When pouring is completed, the user optionally moves the pouring device to a substantially closed configuration by moving the "loose" wall towards the mounted/fixed wall;

The closed configuration is maintained using the fastening mechanism;

The closure provided by the closed configuration allows for the preservation of the material within the inner bag when the container is stowed; and The pouring device is ready for future use.

The steps above may be performed in the listed order or in a different order. One or some of the steps may optionally be excluded from this method. Any step in this method may be employed as an additional step or a replacement step in other methods described in this disclosure.

An Exemplary Method of Using the Pouring Device Illustrated in FIGS. 2A-2H A user tears a section (which may be optionally marked or perforated) of the container to create an opening of the container;

The user pulls out a portion of the pouring device through the opening, when the pouring device is in the closed configuration;

The user moves the pouring device from a closed configuration to an open configuration by applying pressure on a posterior hinge and an anterior hinge (e.g., with the user's fingertips);

By moving the pouring device from the closed configuration to the open configuration, the sealing mechanism, which connects the at least two walls, optionally breaks;

The user mounts the pouring device to an exterior surface of the container which is adjacent to the opening;

The opening accommodates and holds the shape of the pouring device when the pouring device is mounted in the open configuration;

The user uses the pouring device to pour material (e.g., into a bowl);

When pouring is completed, the user may unfold the closing mechanism and apply it onto an exit aperture of the conduit of the pouring device in order to preserve the material during storage, when the pouring device is in the open configuration. Alternatively, the closing mechanism may unfold without user assistance as the pouring device is moved from the closed configuration to the open configuration;

Instead of using the closing mechanism, the user may alternatively choose to move the pouring device to an alternative or additional closing configuration by pushing one of the at least two walls towards the other wall (i.e., the "pushed" wall is no longer mounted);

The closure provided by the closing mechanism or the closure provided by the alternative or additional closing configuration allows for the preservation of the material in the inner bag when the container is stowed; and The pouring device is ready for future use.

The steps above may be performed in the listed order or in a different order. One or some of the steps may optionally be excluded from this method. Any step in this method may be employed as an additional step or a replacement step in other methods described in this disclosure.

An Exemplary Method of Using the Pouring Device Illustrated in FIGS. 3A-3H A user tears a section (which may be optionally marked or perforated) of the container to create an opening of the container;

The user pulls out a portion of the pouring device through the opening, when the pouring device is in the closed configuration;

The user moves the pouring device from a closed configuration to an open configuration by applying pressure on a posterior hinge and an anterior hinge (e.g., with the user's fingertips);

By moving the pouring device from the closed configuration to the open configuration, the sealing mechanism, which connects the at least two walls, optionally breaks;

The user mounts the pouring device to an exterior surface of the container which is adjacent to the opening;

The opening accommodates and holds the shape of the pouring device when the pouring device is mounted in the open configuration;

The user uses the pouring device to pour material (e.g., into a bowl);

When pouring is completed, the user may move the at least one lip part from an extended position to a retracted position to preserve material during stowing of the container. The user may apply the fastening mechanism to maintain the at least one lip part in the retracted position;

Instead of retracting the at least one lip part, the user may alternatively choose to move the pouring device to an alternative or additional closing configuration by pushing the anterior two walls towards the posterior two walls (i.e., the "pushed" two walls are no longer mounted);

The closure provided by the at least one lip part or the closure provided by the alternative or additional closing configuration allow for the preservation of the material within the inner bag when the container is stowed; and The pouring device is ready for future use.

The steps above may be performed in the listed order or in a different order. One or some of the steps may optionally be excluded from this method. Any step in this method may be employed as an additional step or a replacement step in other methods described in this disclosure.

Figure 4B:
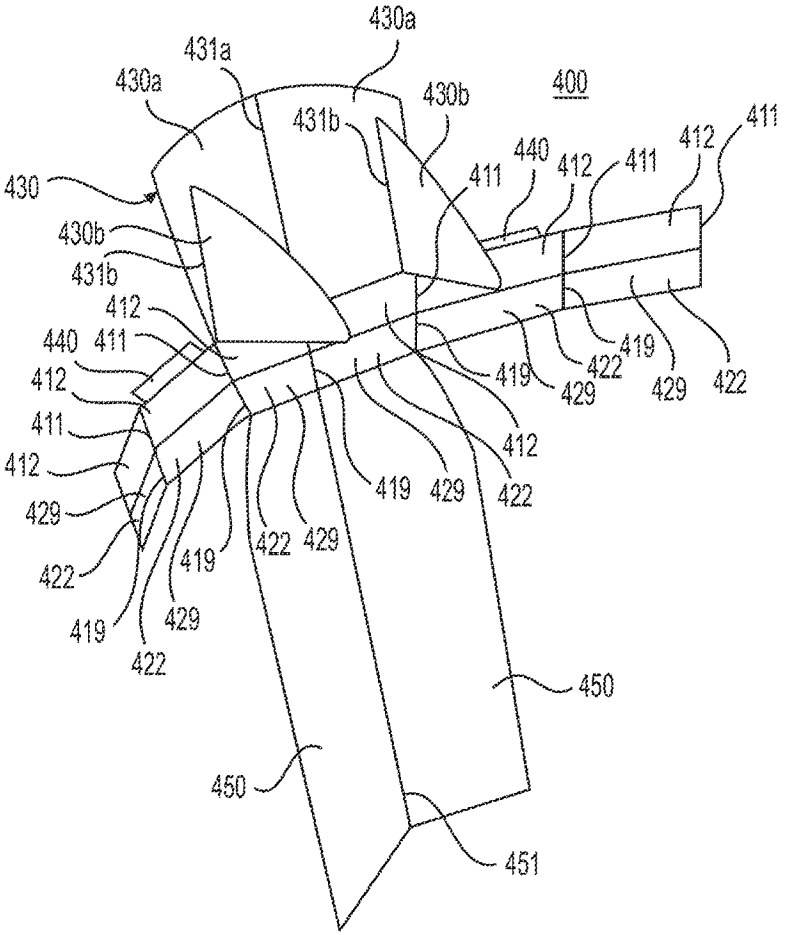
FIG. 4B is a diagram illustrating a perspective view of the pouring device shown in FIG. 4A, wherein the pouring device is disassembled with two end walls not connected. This diagram is shown for purposes of illustration and explanation only.
Figure 4A:
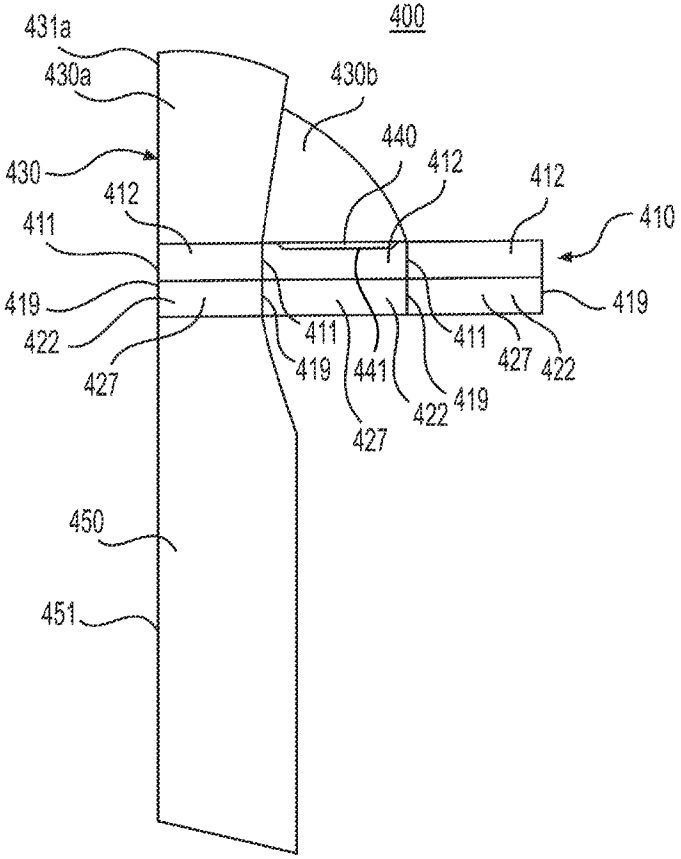
FIG. 4A is a diagram illustrating a side view of another embodiment of a pouring device for pouring material from an inner bag placed within a container. The pouring device is in a closed configuration and includes at least one mounting part and a main body. The main body includes at least two walls, at least one attachment part, at least one lip part, and at least one extension part.
Figure 4D:
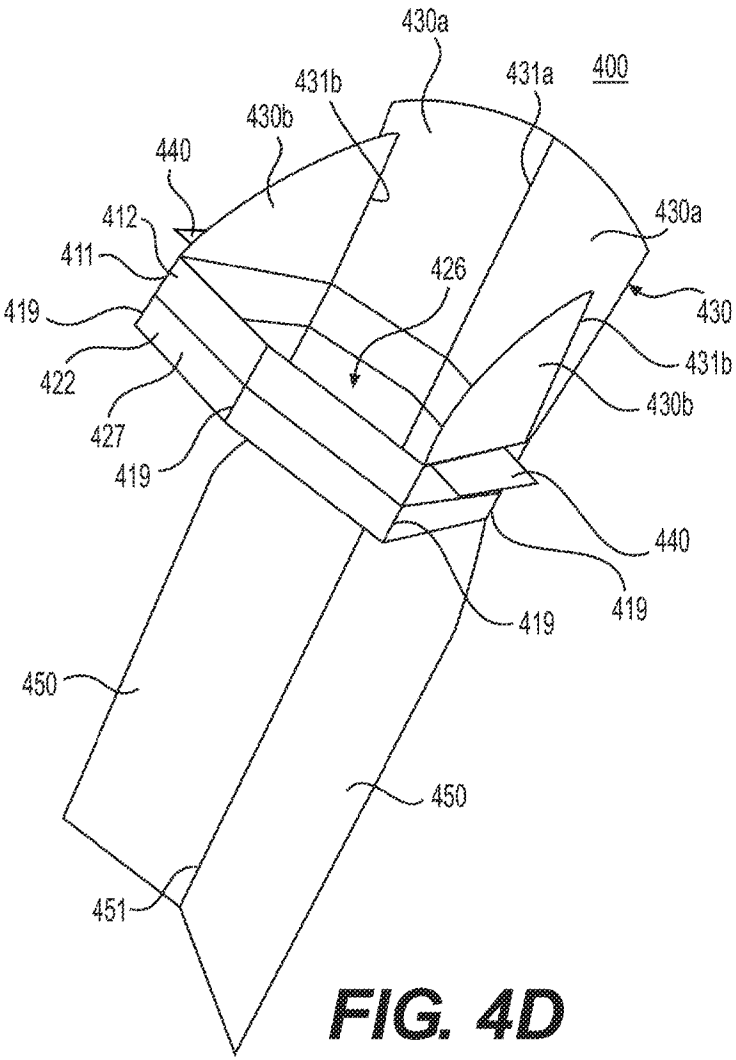
FIG. 4D is a diagram illustrating a perspective view of the pouring device shown in FIG. 4A, wherein the pouring device is in an open configuration and the at least one lip part is in an extended position.
Figure 4C:
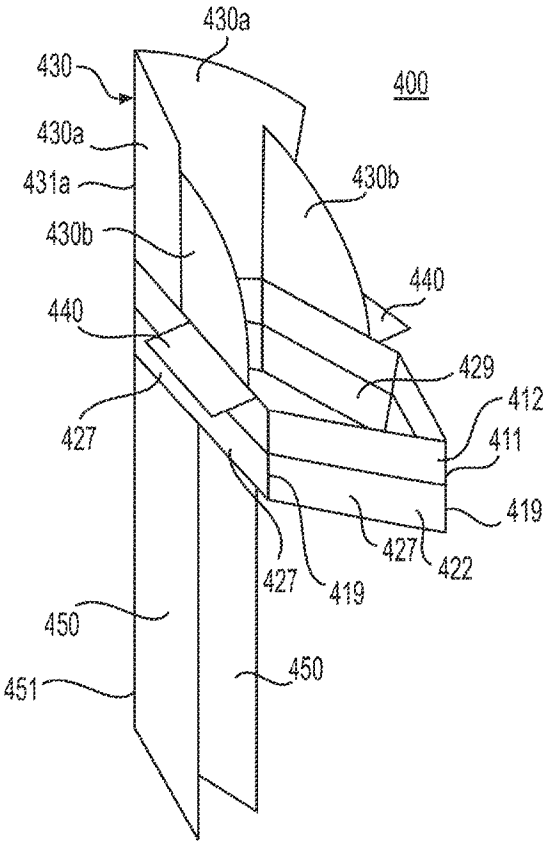
FIG. 4C is a diagram illustrating a perspective view of the pouring device shown in FIG. 4A, wherein the pouring device is in a configuration that is between a closed configuration and an open configuration. The at least one lip part is partially unfolded.
Figure 4F:
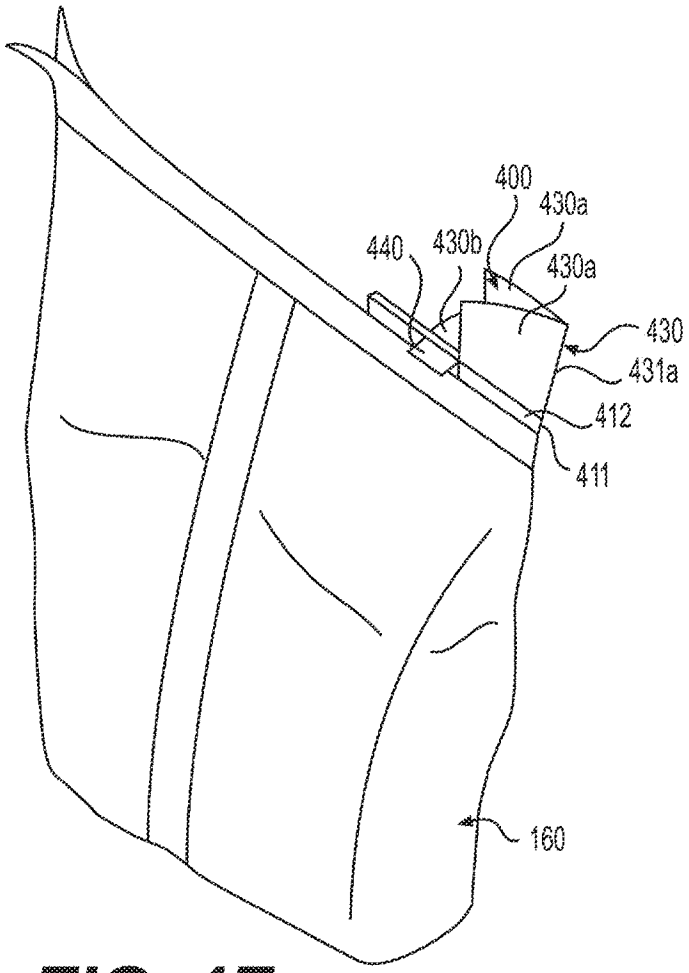
FIG. 4F and FIG. 4G are diagrams illustrating perspective views of the pouring device shown in FIG. 4A, wherein the pouring device is in a substantially closed configuration and the at least one attachment part is attached to an interior surface of the inner bag shown in FIG. 4E.
Figure 4E:
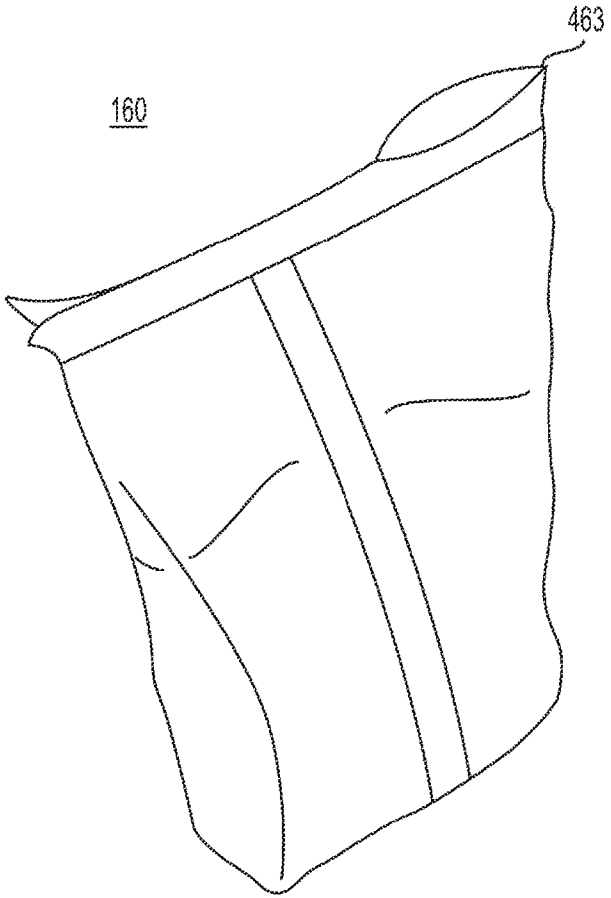
FIG. 4E is a diagram illustrating a perspective view of an inner bag containing material.
Figure 4H:
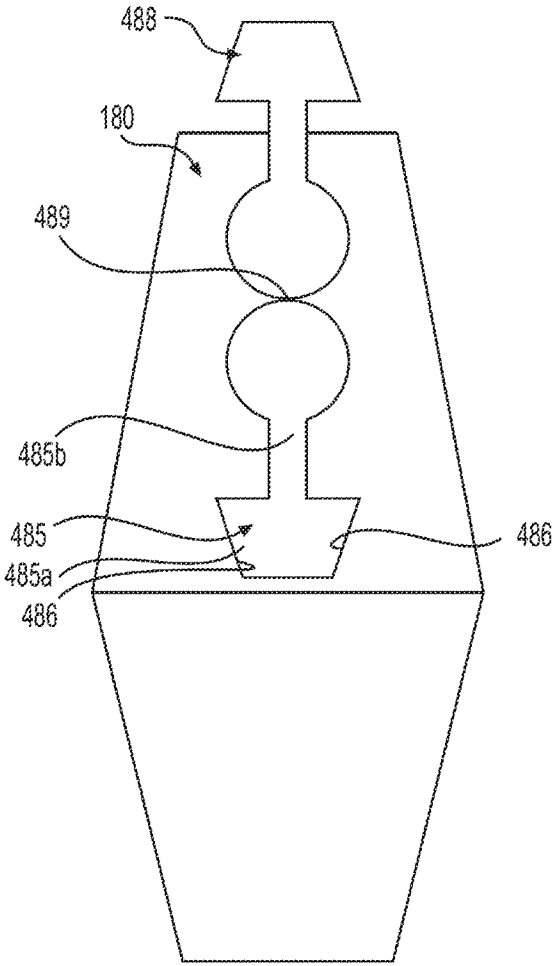
FIG. 4H is a diagram illustrating a perspective view of a container with an opening, wherein the opening is formed by removing a section of the container. The removed section of the container is shown to remain partially attached to the container.
Figure 4G:
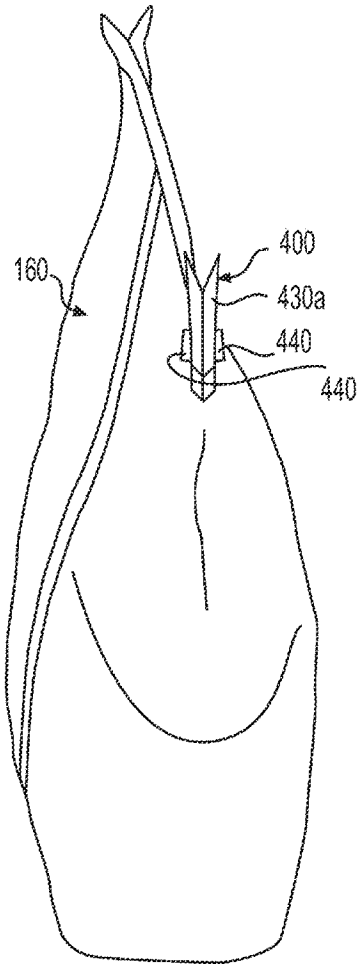
Figure 4I:
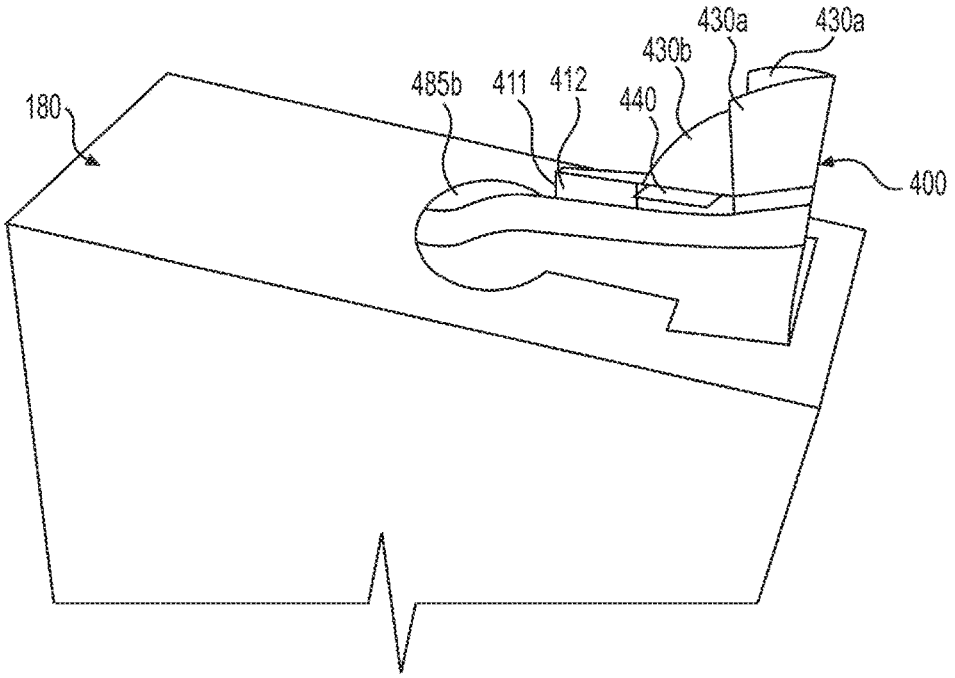
FIG. 4I is a diagram illustrating a perspective view of the pouring device shown in FIG. 4A, wherein the pouring device is in a substantially closed configuration and the at least one attachment part is attached to an interior surface of the inner bag shown in FIG. 4E. At least a portion of the pouring device and a portion of the inner bag are shown to be protruding through the opening of the container shown in FIG. 4H (shown without the partially removed section)
Figure 4J:
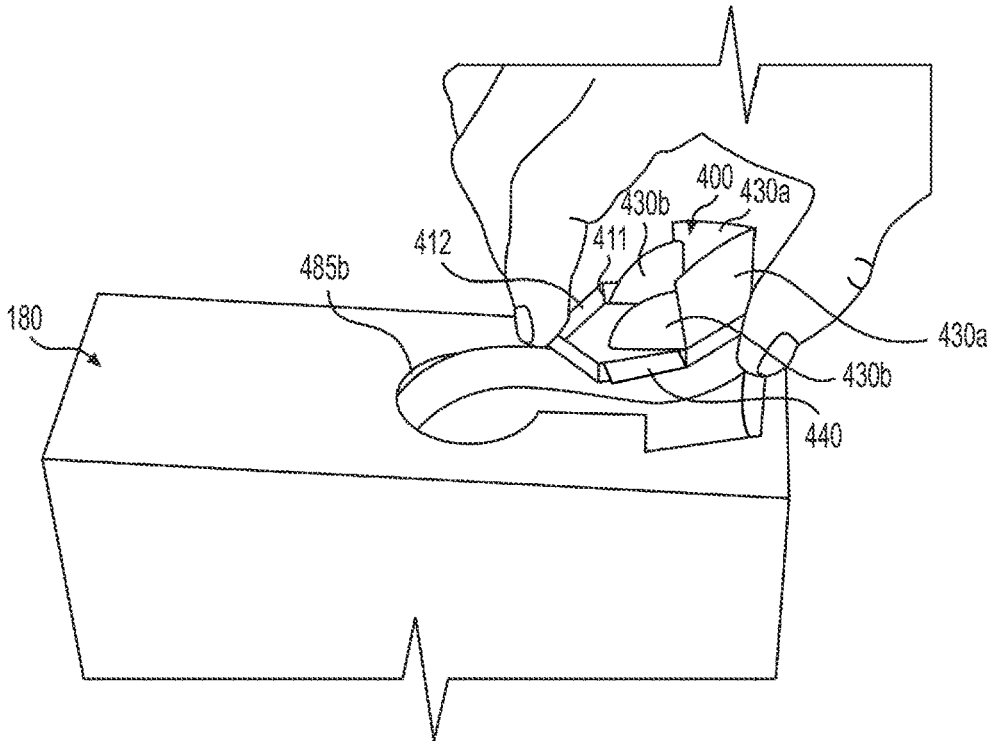
FIG. 4J is a diagram illustrating a perspective view of the pouring device, inner bag, and container shown in FIG. 4I, wherein the pouring device is held by a user from a posterior end and an anterior end of the pouring device. The user is applying pressure on the posterior and anterior ends in order to move the pouring device from a closed configuration to an open configuration.
Figure 4K:
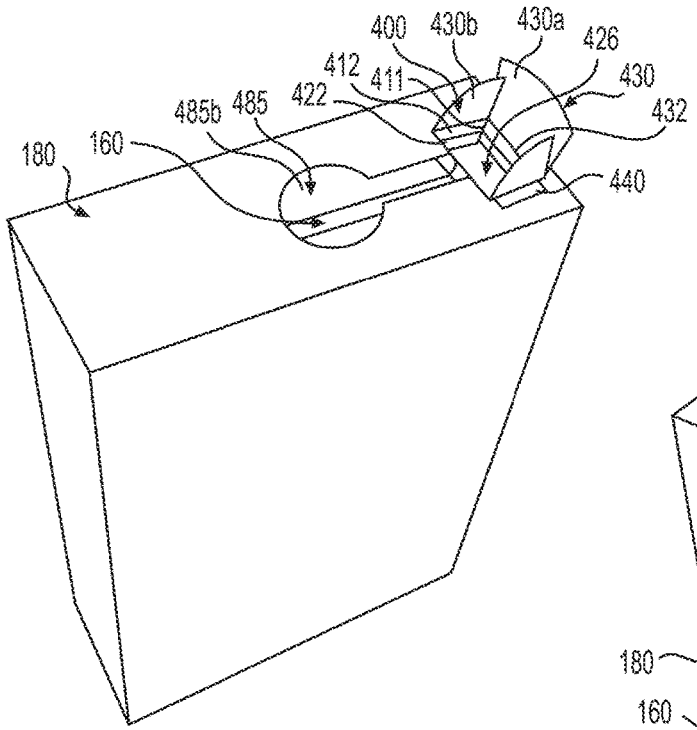
FIG. 4K is a diagram illustrating a perspective view of the pouring device shown in FIG. 4A, wherein the pouring device is in an open configuration, the at least one mounting part is mounted to an exterior surface of the container shown in FIG. 4H (shown without the partially removed section), the at least one attachment part is attached to an interior surface of the inner bag shown in FIG. 4E (inner bag placed inside the container), and the at least one lip part is in an extended position.
Figure 4L:
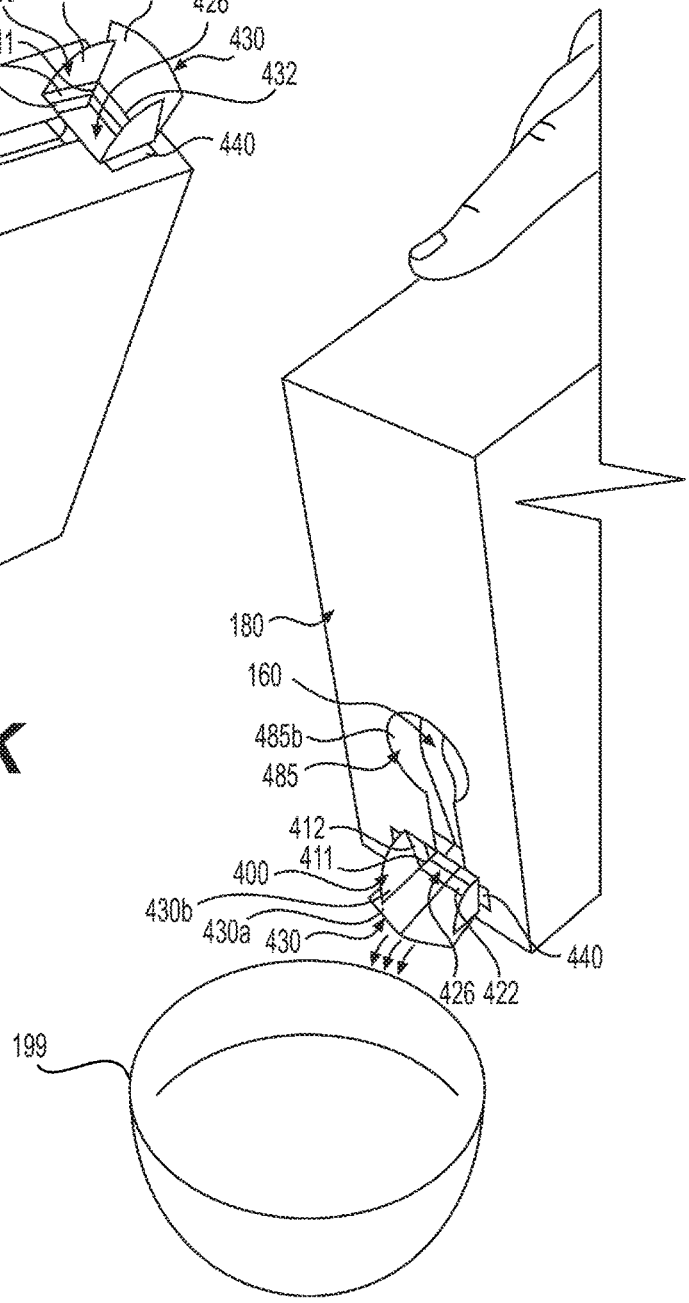
FIG. 4L is a diagram illustrating a perspective view of the pouring device, inner bag, and container shown in FIG. 4K, wherein the pouring device is used by a user to pour material from the inner bag into a bowl.
Figure 4N:
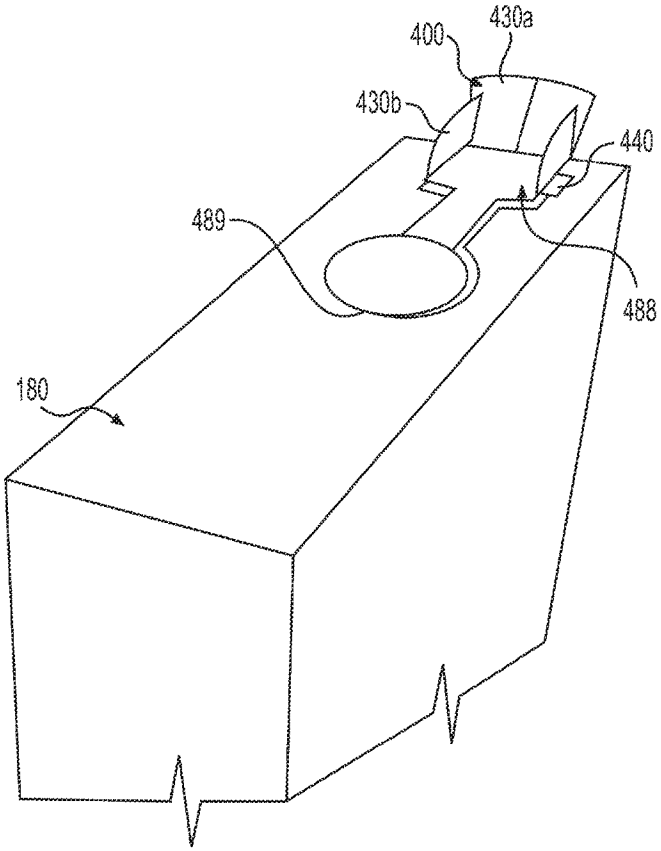
FIG. 4N is a diagram illustrating a perspective view of the pouring device, inner bag, and container shown in FIG. 4K, wherein a portion of the partially removed section of the container shown in FIG. 4H is used to substantially close the conduit of the pouring device, when the pouring device is in an open configuration.

An Exemplary Method of Using the Pouring Device Illustrated in FIGS. 4A-4N

A user tears a section (which may be optionally marked or perforated) of the container to create an opening of the container;

The user pulls out a portion of the pouring device through the opening, when the pouring device is in the closed configuration;

The user moves the pouring device from a closed configuration to an open configuration by applying pressure on a posterior hinge and an anterior hinge (e.g., with the user's fingertips);

By moving the pouring device from the closed configuration to the open configuration, the sealing mechanism, which connects the at least two walls, optionally breaks;

The user mounts the pouring device to an exterior surface of the container which is adjacent to the opening;

The opening accommodates and holds the shape of the pouring device when the pouring device is mounted in the open configuration;

The user uses the pouring device to pour material (e.g., into a bowl);

When pouring is completed, the user may move the at least one lip part from an extended position to a retracted position to preserve the material during stowing of the container. The user may lock the at least one lip part at least partly within a slit of the container or a slit of the another portion of the main body;

Instead of moving the at least one lip part to the retracted position, the user may alternatively apply at least a portion of the removed section of the container onto the conduit to substantially close the conduit;

The closure provided by the at least one lip part or by the removed section of the container allows for the preservation of the material in the inner bag when the container is stowed; and The pouring device is ready for future use.

The steps above may be performed in the listed order or in a different order. One or some of the steps may optionally be excluded from this method. Any step in this method may be employed as an additional step or a replacement step in other methods described in this disclosure.

Exemplary Embodiments

FIG. 1A is a diagram illustrating a perspective view of an embodiment of a pouring device 100 for pouring material from an inner bag placed within a container. The pouring device 100 is in a substantially closed configuration and includes at least one mounting part 40 and a main body 10. The main body 10 includes at least two walls 12, at least one attachment part 22, and at least one extension part 50;

FIG. 1B is a diagram illustrating a perspective view of the pouring device 100 shown in FIG. 1A, wherein the pouring device 100 is in an open configuration;

FIG. 1C is a diagram illustrating a perspective view of the pouring device 100 shown in FIG. 1A, wherein the pouring device 100 is in a substantially closed configuration and the at least one attachment part 22 is attached to an exterior surface of an inner bag 160;

FIG. 1D is a diagram illustrating a perspective view of the pouring device 100 and inner bag 160 shown in FIG. 1C, wherein the pouring device 100 is in an open configuration;

FIG. 1E is a diagram illustrating a perspective view of a container 180 with an opening 185.

Figure 1F:
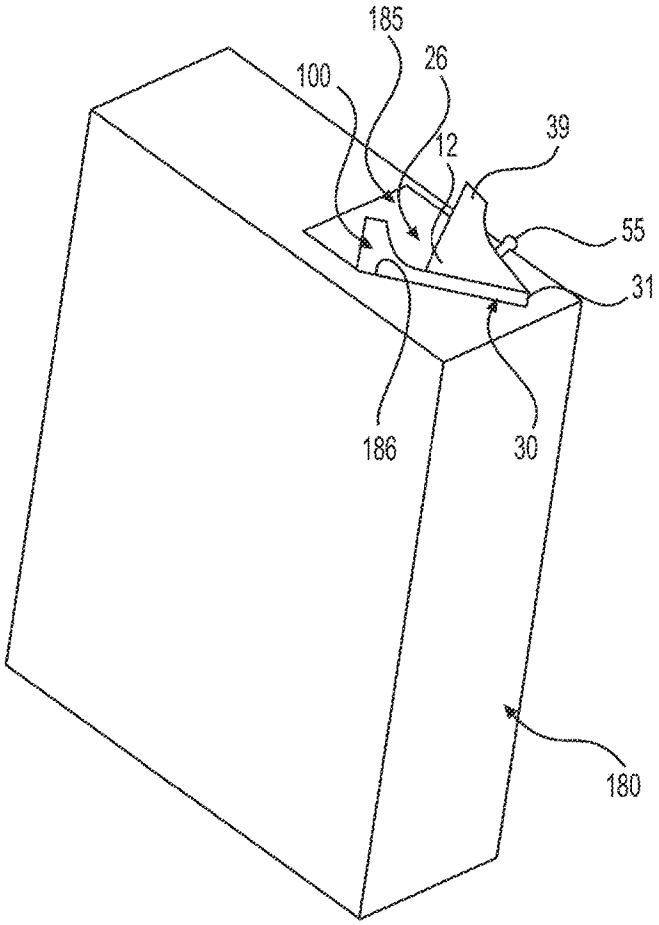
FIG. 1F is a diagram illustrating a perspective view of the pouring device shown in FIG. 1A, wherein the pouring device is in an open configuration, and wherein the pouring device is mounted (via the at least one mounting part) to an interior surface of the container.
Figure 4M:
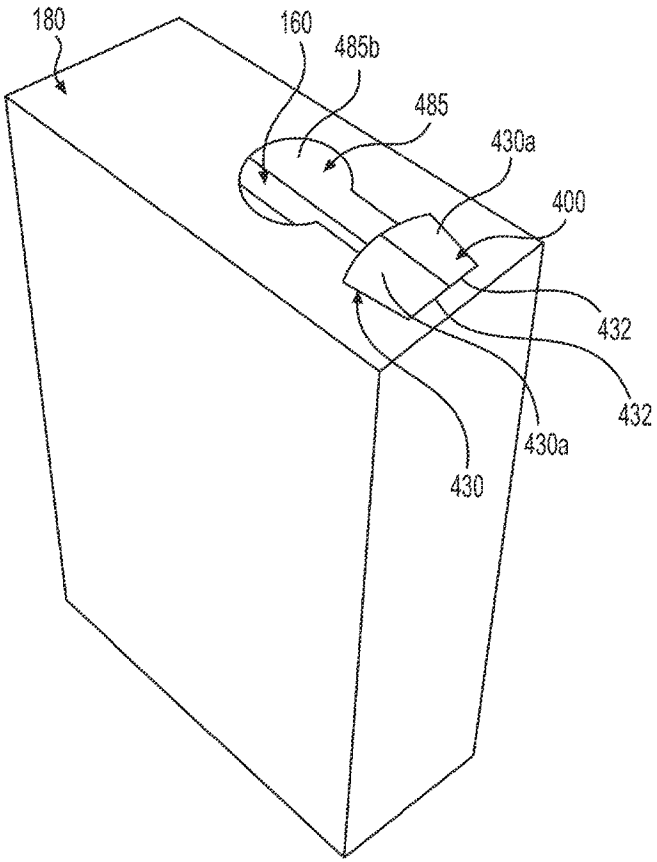
FIG. 4M is a diagram illustrating a perspective view of the pouring device, inner bag, and container shown in FIG. 4K, wherein the at least one lip part is in a retracted position.

FIG. 1F is a diagram illustrating a perspective view of the pouring device 100 shown in FIG. 1A, wherein the pouring device 100 is in an open configuration, and wherein the pouring device 100 is mounted to an interior surface of the container 180 via at least one mounting mechanism 41 provided at a top surface of the at least one mounting part 40 (see FIG. 1A);

FIG. 1G is a diagram illustrating a perspective view of the pouring device 100 and container 180 shown in FIG. 1F, wherein the pouring device 100 is in a substantially closed configuration utilizing a fastening mechanism 55, and wherein the at least one mounting part 40 remains partially mounted to an interior surface of the container;

FIG. 2A is a diagram illustrating a perspective view of another embodiment of a pouring device 200 for pouring material from an inner bag 160 placed within a container 180. The pouring device 200 is in a substantially closed configuration and includes at least one mounting part 240 and a main body 210. The main body 210 includes at least two walls 212, and at least one attachment part 222, and a closing mechanism 257;

FIG. 2B is a diagram illustrating a perspective view of the pouring device 200 shown in FIG. 2A, wherein the pouring device 200 is in an open configuration and the closing mechanism 257 is unfolded;

FIG. 2C is a diagram illustrating a perspective view of the pouring device 200 shown in FIG. 2A, wherein the pouring device 200 is in a substantially closed configuration and the at least one attachment part 222 is attached to an interior surface of an inner bag 160;

FIG. 2D is a diagram illustrating a perspective view of the pouring device 200 and inner bag 160 shown in FIG. 2C, wherein the pouring device 200 is in an open configuration and the closing mechanism 257 is unfolded;

FIG. 2E is a diagram illustrating a perspective view of a container 180 with an opening 285;

FIG. 2F is a diagram illustrating a perspective view of the pouring device 200 shown in FIG. 2A, wherein the pouring device 200 is in an open configuration, the at least one mounting part 240 is mounted to an exterior surface of the container 180 via at least one mounting mechanism 241 provided at a bottom surface of the at least one mounting part 240 (see FIG. 2A), and the closing mechanism 257 is unfolded;

FIG. 2G is a diagram illustrating a perspective view of the pouring device 200 and container 180 shown in FIG. 2F, wherein the pouring device 200 is in a substantially closed configuration, and wherein the at least one mounting part 240 remains partially mounted to an exterior surface of the container 180;

FIG. 2H is a diagram illustrating a perspective view of the pouring device 200 and container 180 shown in FIG. 2F, wherein the unfolded closing mechanism 257 is applied to an exit aperture of the conduit 226 (see FIG. 2F) of the pouring device 200 to maintain substantial closure of the conduit 226, when the pouring device 200 is in an open configuration;

FIG. 3A is a diagram illustrating a perspective view of another embodiment of a pouring device 300 for pouring material from an inner bag 160 placed within a container 180. The pouring device 300 is in a substantially closed configuration and includes at least one mounting part 340 and a main body 310. The main body 310 includes at least two walls 312, at least one attachment part 322, at least one lip part 330, and at least one extension part 350;

FIG. 3B is a diagram illustrating a perspective view of the pouring device 300 shown in FIG. 3A, wherein the pouring device 300 is in an open configuration and the at least one lip part 330 is in an extended position;

FIG. 3C is a diagram illustrating a perspective view of the pouring device 300 shown in FIG. 3A, wherein the pouring device 300 is in a substantially closed configuration and the at least one attachment part 322 is attached to an interior surface of an inner bag 160, and wherein the at least one lip part 330 is in an extended position;

FIG. 3D is a diagram illustrating a perspective view of the pouring device 300 and inner bag 160 shown in FIG. 3C, wherein the pouring device 300 is in an open configuration and the at least one lip part 330 is in an extended position;

FIG. 3E is a diagram illustrating a perspective view of a container 180 with an opening 385;

FIG. 3F is a diagram illustrating a perspective view of the pouring device 300 shown in FIG. 3A, wherein the pouring device 300 is in an open configuration and the at least one attachment part 322 is attached to an interior surface of an inner bag 160, the at least one mounting part 340 is mounted to an exterior surface of the container 180 via at least one mounting mechanism 341 provided at a bottom surface of the at least one mounting part 340 (see FIG. 3A), and the at least one lip part 330 is in an extended position;

FIG. 3G is a diagram illustrating a perspective view of the pouring device 300 and container 180 shown in FIG. 3F, wherein the pouring device 300 is in a closed configuration, and wherein the at least one mounting part 340 remains partially mounted to an exterior surface of the container 180;

FIG. 3H is a diagram illustrating a perspective view of the pouring device 300 and container 180 shown in FIG. 3F, wherein the at least one lip part 330 is in a retracted position and substantially closes the conduit 326 of the pouring device 300, when the pouring device 300 is in an open configuration;

FIG. 4A is a diagram illustrating a side view of another embodiment of a pouring device 400 for pouring material from an inner bag 160 placed within a container 180. The pouring device 400 is in a closed configuration and includes at least one mounting part 440 and a main body 410. The main body 410 includes at least two walls 412, at least one attachment part 422, at least one lip part 430, and at least one extension part 450;

FIG. 4B is a diagram illustrating a perspective view of the pouring device 400 shown in FIG. 4A, wherein the pouring device 400 is disassembled with two end walls 412 not connected by a wall hinge 411 and with the two end attachment portions of the at least one attachment part 422 not connected by an attachment hinge 419. This diagram is shown for purposes of illustration and explanation only;

FIG. 4C is a diagram illustrating a perspective view of the pouring device 400 shown in FIG. 4A, wherein the pouring device 400 is in a configuration that is between a closed configuration and an open configuration. The at least one lip part 430 is partially unfolded;

FIG. 4D is a diagram illustrating a perspective view of the pouring device 400 shown in FIG. 4A, wherein the pouring device 400 is in an open configuration and the at least one lip part 430 is in an extended position;

FIG. 4E is a diagram illustrating a perspective view of an inner bag 160 containing material;

FIG. 4F and FIG. 4G are diagrams illustrating perspective views of the pouring device 400 shown in FIG. 4A, wherein the pouring device 400 is in a substantially closed configuration and the at least one attachment part 422 is attached to an interior surface of the inner bag 160 shown in FIG. 4E;

FIG. 4H is a diagram illustrating a perspective view of a container 180 with an opening 485, wherein the opening 485 is formed by removing a section 488 of the container 180. The removed section 488 is shown to remain partially attached to the container 180 via a remaining section 489;

FIG. 4I is a diagram illustrating a perspective view of the pouring device 400 shown in FIG. 4A, wherein the pouring device 400 is in a substantially closed configuration and the at least one attachment part 422 is attached to an interior surface of the inner bag 160 shown in FIG. 4E. At least a portion of the pouring device 400 and a portion of the inner bag 160 are shown to be protruding through the opening 485 of the container 180 shown in FIG. 4H (shown without the partially removed section);

FIG. 4J is a diagram illustrating a perspective view of the pouring device 400, inner bag 160, and container 180 shown in FIG. 4I, wherein the pouring device 400 is held by a user from a posterior end and an anterior end of the pouring device 400. The user is applying pressure on the posterior and anterior ends in order to move the pouring device 400 from a closed configuration to an open configuration;

FIG. 4K is a diagram illustrating a perspective view of the pouring device 400 shown in FIG. 4A, wherein the pouring device 400 is in an open configuration, the at least one mounting part 440 is mounted to an exterior surface of the container 180 shown in FIG. 4H (shown without the partially removed section) via at least one mounting mechanism 441 provided at a bottom surface of the at least one mounting part 440 (see FIG. 4A), the at least one attachment part 422 is attached to an interior surface of the inner bag 160 shown in FIG. 4E (inner bag 160 placed inside the container 180), and the at least one lip part 430 is in an extended position;

FIG. 4L is a diagram illustrating a perspective view of the pouring device 400, inner bag 160, and container 180 shown in FIG. 4K, wherein the pouring device 400 is used by a user to pour material from the inner bag 160 into a bowl 199;

FIG. 4M is a diagram illustrating a perspective view of the pouring device 400, inner bag 160, and container 180 shown in FIG. 4K, wherein the at least one lip part 430 is in a retracted position; and FIG. 4N is a diagram illustrating a perspective view of the pouring device 400, inner bag 160, and container 180 shown in FIG. 4K, wherein a portion of the partially removed section 488 of the container 180 shown in FIG. 4H is used to substantially close the conduit 426 of the pouring device 400, when the pouring device 400 is in an open configuration.

With reference to FIGS. 1A-4N, embodiments are directed to a pouring device 100, 200, 300, 400 for pouring material from an inner bag 160 placed within a container 180 to an exterior of the container 180 via an opening 185, 285, 385, 485 of the container 180, the pouring device 100, 200, 300, 400 being movable between a closed configuration and an open configuration different from the closed configuration. The pouring device 100, 200, 300, 400 comprises a main body 10, 210, 310, 410 which comprises at least two walls 12, 212, 312, 412. A plurality of the at least two walls 12, 212, 312, 412 are not substantially planar with respect to each other. The at least two walls 12, 212, 312, 412 extend angularly away from each other so that the at least two walls 12, 212, 312, 412 form a conduit 26, 226, 326, 426 therebetween, when the pouring device 100, 200, 300, 400 is in the open configuration, thereby allowing the material from the inner bag 160 to flow through the conduit 26, 226, 326, 426 to the exterior of the container 180 via the opening 185, 285, 385, 485 of the container 180. The main body also comprises at least one attachment part 22, 222, 322, 422 connected to the at least two walls 12, 212, 312, 412. At least a portion of each attachment part 22, 222, 322, 422 is configured to be attached to a portion of the inner bag 160 via an attachment mechanism 27, 227, 327, 427, when the pouring device 100, 200, 300, 400 is in the open and closed configurations. The pouring device also comprises at least one mounting part 40, 240, 340, 440 connected to the main body 10, 210, 310, 410. At least a portion of each mounting part 40, 240, 340, 440 is configured to be attached to a portion of the container 180 via at least one mounting mechanism 41, 241, 341, 441 or to be placed against the portion of the container 180, when the pouring device 100, 200, 300, 400 is in the open configuration.

In an embodiment, the at least two walls 12, 212, 312, 412 are connected via at least one wall hinge 11, 211, 311, 411 (e.g. FIGS. 1A, 1B, 2A, 3B, 4A, 4B), wherein the at least two walls 12, 212, 312, 412 extend angularly away from each other via the at least one wall hinge 11, 211, 311, 411, when the pouring device is in the open configuration.

Attachment

In an embodiment, the at least one attachment part 422 comprises a plurality of attachment portions connected via at least one attachment hinge 419 (e.g. FIGS. 4A, 4B, 4C).

In an embodiment, the at least one attachment part 22 may be connected to the at least two walls via at least one attachment-wall hinge 23 (e.g. FIGS. 1A, 1B)

In an embodiment, the attachment mechanism 27, 227, 327, 427 is positioned at least partly along at least a portion of a width of the at least one attachment part 22, 222, 322, 422, wherein the portion of the inner bag 160 is laterally adjacent to a portion of a seal area of the inner bag 160 (e.g., FIGS. 1C, 2C, 3C, 4F).

In an embodiment, the attachment mechanism 227, 327, 427 is positioned on an exterior surface of the at least a portion of the at least one attachment part 222, 322, 422, wherein the portion of the inner bag 160 comprises an interior surface of the inner bag 160 which is exposed to an interior space of the inner bag 160 (e.g., FIGS. 2C, 3C, 4F).

In an embodiment, the attachment mechanism 27 is positioned on an interior surface of the at least a portion of the at least one attachment part 22, wherein the portion of the inner bag 160 comprises an exterior surface of the inner bag 160 which is not exposed to an interior space of the inner bag 160 (e.g., FIGS. 1C, 1D).

In an embodiment, the attachment mechanism 427 is positioned at least partly along at least a portion of a width of the at least one attachment part 422, wherein the portion of the inner bag 160 is a terminal edge 463 of the inner bag 160, and wherein the terminal edge 463 is an edge of the inner bag 160 not exposed to an interior space of the inner bag 160 (e.g., terminal edges shown in FIGS. 4E, 4F, 4G).

Mounting

In an embodiment, the at least one mounting mechanism 41 is positioned on an upper surface of at least a portion of the at least one mounting part 40, wherein the portion of the container 180 comprises an interior surface of the container 180 which is facing an interior space within the container 180 (e.g., FIGS. 1F, 1G).

In an embodiment, the at least one mounting mechanism 241, 341, 441 is positioned on a lower surface of at least a portion of the at least one mounting part 240, 340, 440, wherein the portion of the container 180 comprises an exterior surface of the container 180 which is facing a space exteriorly of the container 180 (e.g., FIGS. 2F, 2G, 3F, 3G, 4K, 4L).

In an embodiment, the at least one mounting mechanism 41, 241, 341, 441 is positioned on a side surface of at least a portion of the at least one mounting part 40, 240, 340, 440, wherein the portion of the container 180 comprises at least a portion of an edge of the opening 185, 285, 385, 485 of the container 180 or another opening different than the opening 185, 285, 385, 485 of the container 180.

In an embodiment, an upper surface of at least a portion of the at least one mounting part 40, 240, 340, 440 is configured to be placed against the portion of the container 180 (i.e., without the use of the at least one mounting mechanism), wherein the portion of the container 180 comprises an interior surface of the container 180.

In an embodiment, a lower surface of at least a portion of the at least one mounting part 40, 240, 340, 440 is configured to be placed against the portion of the container 180 (i.e., without the use of the at least one mounting mechanism), wherein the portion of the container 180 comprises an exterior surface of the container.

In an embodiment, a side surface of at least a portion of the at least one mounting part 40, 240, 340, 440 is configured to be placed against the portion of the container 180 (i.e., without the use of the at least one mounting mechanism), wherein the portion of the container 180 comprises at least a portion of an edge of the opening 185, 285, 385, 485 of the container 180 or another opening different than the opening 185, 285, 385, 485 of the container 180.

General Shape

In an embodiment, the pouring device 100, 200, 300, 400 is biased towards the closed configuration or is biased towards the open configuration.

In an embodiment, the plurality of the at least two walls 12, 212, 312, 412 face each other and lie substantially in a single plane, when the pouring device 100, 200, 300, 400 is in the closed configuration (e.g., FIGS. 1A, 2A, 3A, 4A).

In an embodiment, the pouring device 400 is capable of being moved from the closed configuration to the open configuration by applying inward pressure on opposing exterior surfaces of the main body 410 (e.g., FIG. 4J).

In an embodiment, the main body 10, 310 further comprises a releasable fastening mechanism 55, 355 attached to at least one of the at least two walls 12, 312 or the at least one attachment part 22, 322 (e.g., FIGS. 1A, 3A).

In an embodiment, the main body 10, 310 further comprises a releasable fastening mechanism 55, 355 attached to a first portion of the main body 10, 310 (e.g., FIGS. 1A, 3A).

In an embodiment, the closed configuration of the pouring device 100 is maintained by releasably fastening, via the releasable fastening mechanism 55, the first portion of the main body 10 to a second portion of the main body 10 or to an exterior surface of the container 180 (e.g., FIG. 1A).

In an embodiment, the open configuration of the pouring device 100 is maintained by releasably fastening, via the releasable fastening mechanism 55, the first portion of the main body 10 to an exterior surface of the container 180 (e.g., FIG. 1F).

Opening

In an embodiment, at least a portion of the at least two walls 412 and at least a portion of the at least one mounting part 440 are capable of passing through the opening 485 of the container 180, when the pouring device 400 is in the closed configuration (e.g., FIGS. 4I, 4J).

In an embodiment, the main body 10, 210, 310, 410 defines a shape when the pouring device 100, 200, 300, 400 is in the open configuration, wherein the opening 185, 285, 385, 485 of the container 180 accommodates the shape defined by the main body 10, 210, 310, 410 (e.g., FIGS. 1F, 2F, 3F, 4K).

In an embodiment, the opening 485 of the container 180 is formed by at least partly removing a section 488 of the container 180 (e.g., FIG. 4H), wherein at least a portion of the at least partly removed section 488 of the container 180 is capable of closing the conduit 426, when the pouring device 400 is in the open configuration, thereby preventing the material from flowing through the conduit 426 (e.g., FIG. 4N).

In an embodiment, the opening 185, 285, 385, 485 of the container 180 may comprise a main portion 185*a*, 285*a*, 385*a*, 485*a* which includes edges 186, 286, 386, 486 that the pouring device 100, 200, 300, 400 mounts to. Opening 185, 285, 385, 485 may also comprise a secondary portion 185*b*, 285*b*, 385*b*, 485*b* that the user may utilize (e.g., along with the main portion 185*a*, 285*a*, 385*a*, 485*a*) to grab and pull out the pouring device 100, 200, 300, 400 from within the container 180 (e.g., FIGS. 1E, 2E 3E, 4H). The edges 186, 286, 386, 486 may help form the shape of the extended at least one lip part 30, 330, 430 when the pouring device 100, 300, 400 is mounted in the open configuration (e.g., FIGS. 1F, 3F, 4K).

Sealing Mechanism

In an embodiment, the main body 10, 210, 310, 410 further comprises a sealing mechanism 29, 229, 329, 429 (which may be resealable), wherein the inner bag 160 is closed via sealing of the sealing mechanism 29, 229, 329, 429 when the pouring device 100, 200, 300, 400 is in the closed configuration (e.g., see sealing mechanisms in FIGS. 1A, 2B, 3B, 4B).

In an embodiment, the inner bag 160 is opened via unsealing of the sealing mechanism 29, 229, 329, 429 when the pouring device 100, 200, 300, 400 is moved from the closed configuration to the open configuration (e.g., FIG. 1A, 2B, 3B, 4B, 4J).

In an embodiment, the pouring device 100, 200, 300, 400 is biased towards the open configuration, wherein the sealing mechanism 29, 229, 329, 429 maintains the closed configuration of the pouring device 100, 200, 300, 400 when the sealing mechanism 29, 229, 329, 429 is sealed (e.g., the pouring device 100, 200, 300, 400 biased to open, but it is kept from opening by the sealing mechanism 29, 229, 329, 429).

Extension Part

In an embodiment, the main body 10, 310, 410 further comprises at least one extension part 50, 350, 450 that extends from at least one of the at least two walls 12, 312, 412 or the at least one attachment part 22, 322, 422, wherein the at least one extension part 50, 350, 450 is configured to extend into the inner bag 160 to facilitate the flow of the material through the conduit 26, 326, 426 and/or to provide rigidity to the inner bag 160 (e.g., FIGS. 1B, 3B, 4D).

In an embodiment, the at least one extension part 350, 450 comprises a plurality of extension portions connected via at least one extension hinge 351, 451 (e.g., FIGS. 3A, 3B, 4A, 4B).

In an embodiment, the at least one extension part 50 comprises a plurality of unconnected extension portions (e.g., FIGS. 1A, 1B).

Closing Mechanism

In an embodiment, the main body 210 further comprises a closing mechanism 257 connected to the main body 210, wherein the closing mechanism 257 substantially closes the conduit 226, when the pouring device 200 is in the open configuration, thereby substantially preventing the material from flowing through the conduit 226 (e.g., FIG. 2H).

In an embodiment, the closing mechanism 257 is positioned at a distance from the conduit 226, when the pouring device 200 is in the closed configuration (e.g., FIGS. 2A, 2C).

In an embodiment, the closing mechanism 257 comprises an optional closing hinge 259, wherein the closing mechanism 257 includes closing portions (e.g., panels or walls) 258 which are folded along the closing hinge 259, when the pouring device 200 is in the closed configuration (e.g., FIGS. 2A, 2C).

In an embodiment, the closing mechanism 257 is an extendable and retractable closing mechanism, wherein the closing mechanism 257 is capable of extending angularly away from the conduit 226 and is capable of retracting angularly towards the conduit 226, when the pouring device 200 is in the open configuration (e.g., FIGS. 2F, 2H).

In an embodiment, the main body 210 further comprises a closing mechanism 257 extending from the main body 210 and positioned at an exit aperture of the conduit 226 to maintain substantial closure of the conduit 226 via the closing mechanism 257, when the pouring device 200 is in the open configuration (e.g., FIG. 2H). The closing mechanism 257 in this embodiment is unfolded when the closure mechanism 257 has the optional fold via the closing hinge 259.

Lip Part

In an embodiment, the main body 10, 310, 410 further comprises at least one lip part 30, 330, 430, wherein the at least one lip part 30, 330, 430 extends from at least one of the at least two walls 12, 312, 412 or the at least one attachment part 22, 322, 422, to the exterior of the container 180, when the pouring device 100, 300, 400 is in the open configuration (e.g., FIGS. 3B, 4D and 1B/1F to a certain extent with a small lip showing in FIG. 1F).

In an embodiment, the at least one lip part 30 may optionally include a handling portion 39 extending from at least one of the lip portions 30*a* to facilitate gripping by the user (e.g., FIG. 1A).

In an embodiment, the at least one lip part 30, 330, 430 comprises a plurality of lip portions 30*a*, 330*a*, 330*b*, 430*a*, 430*b* connected via at least one lip hinge 31, 331*a*, 331*b*, 431*a*, 431*b* (e.g., FIGS. 1B, 3B, 4D).

In an embodiment, the plurality of lip portions 30*a*, 330*a*, 330*b*, 430*a*, 430*b* face each other and lie substantially in a single plane, when the pouring device 100, 300, 400 is in the closed configuration (e.g., FIGS. 1A, 1G, 3A, 4A). In FIGS. 4B, 4D, lip portions 430*b* are connected to lip portions 430*a* via lip hinges 431*b*.

In an embodiment, the at least one lip part 330, 430 is connected to the at least one of the at least two walls 312, 412 via at least one wall-lip hinge 332, 432, such that the at least one lip part 330, 430 is capable of extending angularly away from the conduit 326, 426 and retracting angularly towards the conduit 326, 426 via the at least one wall-lip hinge 332, 432 (e.g., FIGS. 3F, 3H, 4K, 4M).

In an embodiment, the at least one lip part 30, 330, 430 is biased towards being extended, towards being retracted, or towards both being extended and being retracted.

In an embodiment, the at least one lip part 330, 430, when retracted, substantially closes the conduit 326, 426 when the pouring device 300, 400 is in the open configuration, thereby substantially preventing the material from flowing through the conduit 326, 426 (e.g., FIGS. 3H, 4M).

In an embodiment, the at least one lip part either remains retracted via mechanical interconnection of the at least one lip part with a slit of the container or with a slit of another portion of the main body.

In an embodiment, the main body 10, 310 further comprises a releasable fastening mechanism 55, 355 attached to the at least one lip part 30, 330 (e.g., FIGS. 1A, 3A).

In an embodiment, the at least one lip part 330 remains extended by releasably fastening, via the releasable fastening mechanism 355, the at least one lip part 330 to an exterior surface of the container 180.

In an embodiment, the at least one lip part 30, 430 remains extended without the assistance of a releasable fastening mechanism (e.g., FIGS. 1F, 4K, 4L).

In an embodiment, the at least one lip part 330 comprises a first lip portion (330*a* on one side) and a second lip portion (330*a* on the other side), wherein the at least one lip part 330 remains retracted by releasably fastening, via the releasable fastening mechanism 355, the first lip portion (330*a* on the one side) to the second lip portion (330*a* on the other side), at least one of the two walls 312, the at least one attachment part 322, or an exterior surface of the container 180 (e.g., FIG. 3H).

In an embodiment, an angular extension of the at least one lip part 330, 430 away from the conduit 326, 426 is limited, wherein a section of the extended at least one lip part 330, 430 is blocked by a portion of the main body 310, 410 or by an interior portion of the container 180 (e.g., similar to a salt dispenser spout which has a limited extension because it is blocked by an interior portion of the salt container).

Exemplary Methods

Figure 5:
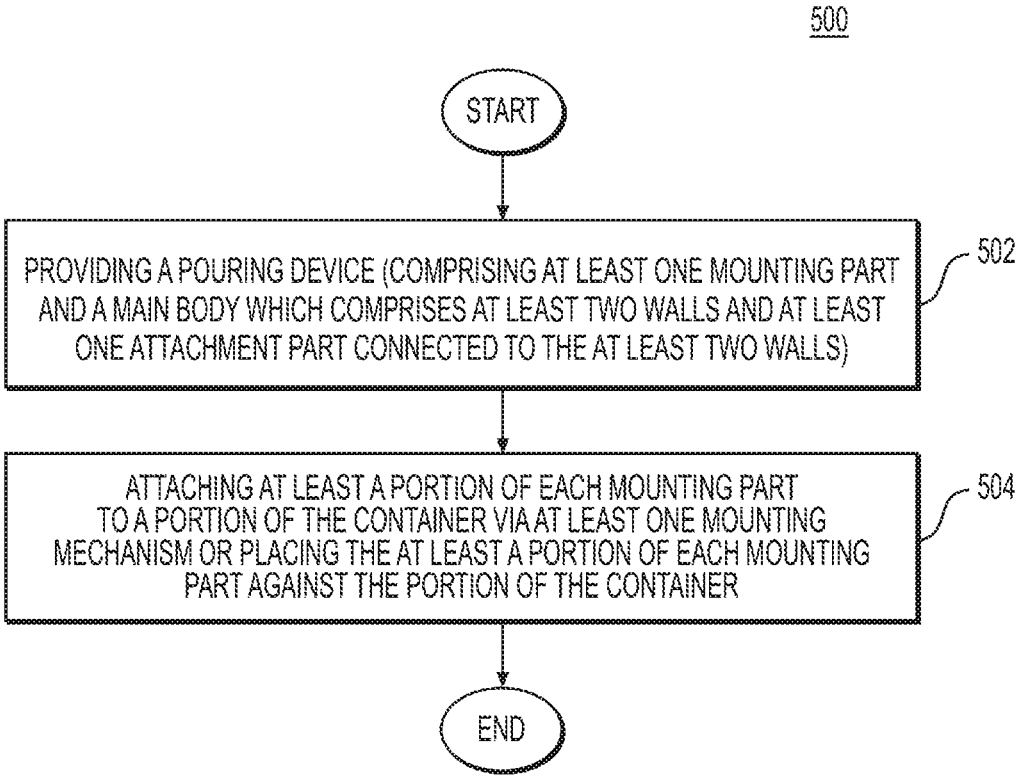
FIG. 5 is a flowchart illustrating an embodiment of a method of using a pouring device for pouring material from an inner bag placed within a container.

Embodiments are also directed to a method of using a pouring device for pouring material from an inner bag placed within a container to an exterior of the container via an opening of the container, the pouring device being movable between a closed configuration and an open configuration different from the closed configuration. FIG. 5 is a flowchart illustrating an embodiment of a method 500 of using a pouring device for pouring material from an inner bag placed within a container. The method 500 comprises providing a pouring device (block 502) which comprises a main body which comprises at least two walls. A plurality of the at least two walls are not substantially planar with respect to each other. The at least two walls extend angularly away from each other so that the at least two walls form a conduit therebetween, when the pouring device is in the open configuration. The main body also comprises at least one attachment part connected to the at least two walls. At least a portion of each attachment part is configured to be attached to a portion of the inner bag via an attachment mechanism, when the pouring device is in the open and closed configurations. The pouring device also comprises at least one mounting part connected to the main body. The method also comprises attaching at least a portion of each mounting part to a portion of the container via at least one mounting mechanism or placing the at least a portion of each mounting part against the portion of the container (block 504), when the pouring device is in the open configuration. The material from the inner bag is allowed to flow through the conduit to the exterior of the container via the opening of the container, when the pouring device is in the open configuration.

In an embodiment, the method further comprises attaching the at least a portion of each attachment part to the portion of the inner bag via the attachment mechanism, when the pouring device is in the open and closed configurations.

In an embodiment, the attachment mechanism is positioned at least partly along at least a portion of a width of the at least one attachment part, wherein the portion of the inner bag laterally adjacent to a portion of a seal area of the inner bag.

In an embodiment, the attachment mechanism is positioned on an exterior surface of the at least a portion of the at least one attachment part, wherein the portion of the inner bag comprises an interior surface of the inner bag which is exposed to an interior space of the inner bag.

In an embodiment, the attachment mechanism is positioned on an interior surface of the at least a portion of the at least one attachment part, wherein the portion of the inner bag comprises an exterior surface of the inner bag which is not exposed to an interior space of the inner bag.

In an embodiment, the attachment mechanism is positioned at least partly along at least a portion of a width of the at least one attachment part, wherein the portion of the inner bag is a terminal edge of the inner bag, and wherein the terminal edge is an edge of the inner bag not exposed to an interior space of the inner bag.

In an embodiment, the at least one mounting mechanism is positioned on an upper surface of at least a portion of the at least one mounting part, wherein the portion of the container comprises an interior surface of the container which is facing an interior space within the container.

In an embodiment, the at least one mounting mechanism is positioned on a lower surface of at least a portion of the at least one mounting part, wherein the portion of the container comprises an exterior surface of the container which is facing a space exteriorly of the container.

In an embodiment, the at least one mounting mechanism is positioned on a side surface of at least a portion of the at least one mounting part, wherein the portion of the container comprises at least a portion of an edge of the opening of the container or another opening different than the opening of the container.

In an embodiment, the method further comprises placing an upper surface of at least a portion of the at least one mounting part against the portion of the container, wherein the portion of the container comprises an interior surface of the container.

In an embodiment, the method further comprises placing a lower surface of at least a portion of the at least one mounting part against the portion of the container, wherein the portion of the container comprises an exterior surface of the container.

In an embodiment, the method further comprises placing a side surface of at least a portion of the at least one mounting part against the portion of the container, wherein the portion of the container comprises at least a portion of an edge of the opening of the container or another opening different than the opening of the container.

In an embodiment, the at least two walls are connected via at least one wall hinge, wherein the at least two walls extend angularly away from each other via the at least one wall hinge, and wherein the method further comprises moving the pouring device from the closed configuration to the open configuration using the at least one wall hinge.

In an embodiment, the at least one attachment part comprises a plurality of attachment portions connected via at least one attachment hinge, wherein the method further comprises moving the pouring device from the closed configuration to the open configuration using the at least one attachment hinge.

In an embodiment, the method further comprises applying inward pressure on opposing exterior surfaces of the main body to move the pouring device from the closed configuration to the open configuration.

In an embodiment, the main body further comprises a releasable fastening mechanism attached to a first portion of the main body.

In an embodiment, the method further comprises maintaining the closed configuration of the pouring device by releasably fastening, via the releasable fastening mechanism, the first portion of the main body to a second portion of the main body or to an exterior surface of the container.

In an embodiment, the method further comprises maintaining the open configuration of the pouring device by releasably fastening, via the releasable fastening mechanism, the first portion of the main body to an exterior surface of the container.

In an embodiment, the method further comprises passing at least a portion of the at least two walls and at least a portion of the at least one mounting part through the opening of the container, when the pouring device is in the closed configuration.

In an embodiment, the main body defines a shape when the pouring device is in the open configuration, wherein the method further comprises inserting the main body having the shape into at least a portion of the opening of the container whereby the shape of the main body is maintained by the at least a portion of the opening of the container.

In an embodiment, the method further comprises forming the opening of the container by at least partly removing a section of the container.

In an embodiment, the method further comprises closing the conduit via replacing at least a portion of the at least partly removed section of the container, when the pouring device is in the open configuration, thereby preventing the material from flowing through the conduit.

In an embodiment, the main body further comprises a sealing mechanism (which may be resealable), wherein the method further comprises closing the inner bag via sealing of the sealing mechanism when the pouring device is in the closed configuration.

In an embodiment, the method further comprises opening the inner bag via unsealing of the sealing mechanism when the pouring device is moved from the closed configuration to the open configuration.

In an embodiment, the main body further comprises at least one extension part that extends from at least one of the at least two walls or the at least one attachment part, wherein the method further comprises extending the at least one extension part into the inner bag to facilitate the flow of the material through the conduit or to provide rigidity to the inner bag.

In an embodiment, the at least one extension part comprises a plurality of extension portions connected via at least one extension hinge, wherein the method further comprises moving the pouring device from the closed configuration to the open configuration using the at least one extension hinge.

In an embodiment, the main body further comprises a closing mechanism connected to the main body, wherein the method further comprises substantially closing the conduit via the closing mechanism, when the pouring device is in the open configuration, thereby substantially preventing the material from flowing through the conduit.

In an embodiment, the closing mechanism comprises an optional closing hinge, wherein the method further comprises folding the closing mechanism along the closing hinge, when the pouring device is in the closed configuration.

In an embodiment, the method further comprises unfolding the folded closing mechanism when the pouring device is moved from the closed configuration to the open configuration.

In an embodiment, the closing mechanism is an extendable and retractable closing mechanism, wherein the method further comprises extending the closing mechanism angularly away from the conduit and retracting the closing mechanism angularly towards the conduit, when the pouring device is in the open configuration.

In an embodiment, the main body further comprises a closing mechanism extending from the main body, wherein the method further comprises positioning the closing mechanism at an exit aperture of the conduit to maintain substantial closure of the conduit via the closing mechanism, when the pouring device is in the open configuration. When applied to the exit aperture of the conduit, the closing mechanism in this embodiment is unfolded via the optional closing hinge.

In an embodiment, the main body further comprises at least one lip part extending from at least one of the at least two walls or the at least one attachment part, wherein the method further comprises passing the at least one lip part through the opening of the container to the exterior of the container.

In an embodiment, the at least one lip part comprises a plurality of lip portions connected via at least one lip hinge, wherein the method further comprises moving the pouring device from the closed configuration to the open configuration using the at least one lip hinge.

In an embodiment, the at least one lip part is connected to the at least one of the at least two walls via at least one wall-lip hinge, wherein the method further comprises extending the at least one lip part angularly away from the conduit and retracting the at least one lip part angularly towards the conduit via the at least one wall-lip hinge.

In an embodiment, the method further comprises substantially closing the conduit via the at least one lip part, when retracted, when the pouring device is in the open configuration, thereby substantially preventing the material from flowing through the conduit.

In an embodiment, the method further comprises mechanically interconnecting the at least one lip part with a slit of the container or with a slit of another portion of the main body to maintain retraction of the at least one lip part.

Additional Description

Although embodiments are described above with reference to a pouring device for attachment to an inner bag within a container, the pouring device or portions thereof described in any of the above embodiments may alternatively be made integral with or formed as a permanent part of an inner bag. Such alternatives are considered to be within the spirit and scope of the present invention, and may therefore utilize the advantages of the configurations and embodiments described above.

In addition, although embodiments are described above with reference to a pouring device for removable mounting to a container, the pouring device described in any of the above embodiments may alternatively be made integral with or formed as a permanent part of a container. Such alternatives are considered to be within the spirit and scope of the present invention, and may therefore utilize the advantages of the configurations and embodiments described above.

Further, although embodiments are described above with reference to a pouring device for pouring material from an inner bag placed within a carton or a rectangular carton box, the pouring device described in any of the above embodiments may alternatively be employed in any container of any type that contains an inner bag, which contains a pourable material. Such alternatives are considered to be within the spirit and scope of the present invention, and may therefore utilize the advantages of the configurations and embodiments described above.

Yet further, although embodiments are described above with reference to a pouring device mounted to a container with an opening on an upper surface/portion/wall of a container, the opening of the container described in any of the above embodiments may alternatively be located on other surfaces/portions/walls of the container (e.g., side surfaces/portions/walls). Such alternatives are considered to be within the spirit and scope of the present invention, and may therefore utilize the advantages of the configurations and embodiments described above.

Yet further, although embodiments are described above with reference to a pouring device with at least one attachment part attached to an upper portion of the inner bag, the at least one attachment part in any of the above embodiments may alternatively be attached to other portions/walls of the inner bag (e.g., side portions). Such alternatives are considered to be within the spirit and scope of the present invention, and may therefore utilize the advantages of the configurations and embodiments described above.

Yet further, although embodiments are described above with reference to a pouring device with at least one mounting part being attached/placed/mounted on surface areas of the container adjacent to an opening of a container, the at least one mounting part of the pouring device described in any of the above embodiments may alternatively be attached/placed/mounted to areas that are not adjacent to an opening of a container (e.g., if the at least one mounting part is suitably configured to allow for distant mounting of the pouring device from the opening). Such alternatives are considered to be within the spirit and scope of the present invention, and may therefore utilize the advantages of the configurations and embodiments described above.

Yet further, although embodiments are described above with reference to a pouring device with at least one mounting part being attached/placed/mounted to exterior and interior surfaces of the container, the at least one mounting part of the pouring device described in any of the above embodiments may alternatively be placed and/or locked into a slit of the container (e.g., a slit that is part of the opening, a slit that is independent of the opening, etc.). Such alternatives are considered to be within the spirit and scope of the present invention, and may therefore utilize the advantages of the configurations and embodiments described above.

Yet further, although embodiments are described above with reference to a pouring device with an even total number of walls (e.g., 2, 4, or 6), the total number of walls of the pouring device described in any of the above embodiments may alternatively be odd (e.g., five walls with five hinges connecting them or five walls with four hinges connecting them). Such alternatives are considered to be within the spirit and scope of the present invention, and may therefore utilize the advantages of the configurations and embodiments described above.

Yet further, although embodiments are described above with reference to a symmetrical pouring device (for example, symmetrical with respect to a central plane passing through a central longitudinal axis of the conduit), the pouring device described in any of the above embodiments may alternatively be made non-symmetrical with respect to the central plane, e.g., with additional (or differently sized) walls on one side of the central perpendicular plane versus the other side of the central plane. Such alternatives are considered to be within the spirit and scope of the present invention, and may therefore utilize the advantages of the configurations and embodiments described above.

Yet further, although embodiments are described above with reference to a pouring device, wherein the at least two walls are substantially close to each other when the pouring device is in the closed configuration, the at least two walls of the pouring device described in any of the above embodiments may alternatively be not substantially close to each other when the pouring device is in the closed configuration (i.e., with a substantial separation). Such alternatives are considered to be within the spirit and scope of the present invention, and may therefore utilize the advantages of the configurations and embodiments described above.

Yet further, although embodiments are described above with reference to a pouring device having planar walls (e.g., flat, straight, etc.), any or all of the at least two walls described in any of the above embodiments may alternatively be non-planar and may comprise, for example, one or more curved (or other shape) walls, surfaces, or portions (e.g., natural curved shapes, bending shapes under stress, surfaces rigidly connected, surfaces connected by hinges, facets, or combinations thereof). The at least one attachment part, the at least one lip part, and/or the at least one extension part may similarly optionally be comprised of non-planar walls as described above. Such alternatives are considered to be within the spirit and scope of the present invention, and may therefore utilize the advantages of the configurations and embodiments described above.

Yet further, although embodiments are described above with reference to a pouring device with uniform walls (e.g., with uniform wall thickness), any or all of the at least two walls described in any of the above embodiments may alternatively be non-uniform (e.g. having varying thickness, discontinuities such as holes, grooves, ridges, slits, combination thereof, etc.) Such alternatives are considered to be within the spirit and scope of the present invention, and may therefore utilize the advantages of the configurations and embodiments described above.

Yet further, in any of the embodiments described above, any of the hinges may comprise a perforation, a crease, a score, a bend, an elbow, a section with less thickness than surrounding material, a section with less density than surrounding material, a combination thereof, etc.

The method steps in any of the embodiments described herein are not restricted to being performed in any particular order. Also, structures mentioned in any of the method embodiments may utilize structures mentioned in any of the device embodiments. Such structures may be described in detail with respect to the device embodiments only but are applicable to any of the method embodiments.

Features in any of the embodiments described in this disclosure may be employed in combination with features in other embodiments described herein, such combinations are considered to be within the spirit and scope of the present invention.

The contemplated modifications and variations specifically mentioned in this disclosure are considered to be within the spirit and scope of the present invention.

More generally, even though the present disclosure and exemplary embodiments are described above with reference to the examples according to the accompanying drawings, it is to be understood that they are not restricted thereto. Rather, it is apparent to those skilled in the art that the disclosed embodiments can be modified in many ways without departing from the scope of the disclosure herein. Moreover, the terms and descriptions used herein are set forth by way of illustration only and are not meant as limitations. Those skilled in the art will recognize that many variations are possible within the spirit and scope of the disclosure as defined in the following claims, and their equivalents, in which all terms are to be understood in their broadest possible sense unless otherwise indicated.

The invention claimed is:

1. A pouring device for pouring material from an inner bag placed within a container to an exterior of the container via an opening of the container, the pouring device being movable between a closed configuration and an open configuration different from the closed configuration, the pouring device comprising:

a main body comprising:

at least two walls hingedly coupled to each other via at least two hinges, wherein the at least two walls move via the at least two hinges when the pouring device is moved from the closed configuration to the open configuration, wherein a perimeter of a conduit is substantially defined by the at least two walls when the pouring device is in the open configuration, and wherein the material from the inner bag is capable of flowing through the conduit to the exterior of the container via the opening of the container when the pouring device is in the open configuration; and at least one attachment part, wherein at least a portion of each attachment part is configured to be attached to a portion of the inner bag via an attachment mechanism, when the pouring device is in the open and closed configurations; and at least one mounting part connected to the main body, wherein at least a portion of each mounting part is configured to be attached to a portion of the container via at least one mounting mechanism or to be placed against the portion of the container, when the pouring device is in the open configuration.

2. The pouring device of claim 1, wherein the at least two walls extend angularly away from each other via the at least two hinges, when the pouring device is in the open configuration.

3. The pouring device of claim 1, wherein the at least one attachment part comprises a plurality of attachment portions hingedly coupled via at least one attachment hinge.

4. The pouring device of claim 1, wherein the attachment mechanism is positioned at least partly along at least a portion of a width of the at least one attachment part, and wherein the portion of the inner bag is laterally adjacent to a portion of a seal area of the inner bag.

5. The pouring device of claim 1, wherein the attachment mechanism is positioned on an exterior surface of the at least a portion of the at least one attachment part, and wherein the portion of the inner bag comprises an interior surface of the inner bag.

6. The pouring device of claim 1, wherein the attachment mechanism is positioned on an interior surface of the at least a portion of the at least one attachment part, and wherein the portion of the inner bag comprises an exterior surface of the inner bag.

7. The pouring device of claim 1, wherein the attachment mechanism is positioned at least partly along at least a portion of a width of the at least one attachment part, wherein the portion of the inner bag is a terminal edge of the inner bag, and wherein the terminal edge is an edge of the inner bag not exposed to an interior space of the inner bag.

8. The pouring device of claim 1, wherein the at least one mounting mechanism is positioned on an upper surface of at least a portion of the at least one mounting part, and wherein the portion of the container comprises an interior surface of the container.

9. The pouring device of claim 1, wherein the at least one mounting mechanism is positioned on a lower surface of at least a portion of the at least one mounting part, and wherein the portion of the container comprises an exterior surface of the container.

10. The pouring device of claim 1, wherein the at least one mounting mechanism is positioned on a side surface of at least a portion of the at least one mounting part, and wherein the portion of the container comprises at least a portion of an edge of the opening of the container or another opening different than the opening of the container.

11. The pouring device of claim 1, wherein an upper surface of at least a portion of the at least one mounting part is configured to be placed against the portion of the container, and wherein the portion of the container comprises an interior surface of the container.

12. The pouring device of claim 1, wherein a lower surface of at least a portion of the at least one mounting part is configured to be placed against the portion of the container, and wherein the portion of the container comprises an exterior surface of the container.

13. The pouring device of claim 1, wherein a side surface of at least a portion of the at least one mounting part is configured to be placed against the portion of the container, and wherein the portion of the container comprises at least a portion of an edge of the opening of the container or another opening different than the opening of the container.

14. The pouring device of claim 1, wherein the pouring device is biased towards the closed configuration or is biased towards the open configuration.

15. The pouring device of claim 1, wherein the plurality of the at least two walls face each other and lie substantially in a single plane, when the pouring device is in the closed configuration.

16. The pouring device of claim 1, wherein the pouring device is capable of being moved from the closed configuration to the open configuration by applying inward pressure on opposing exterior surfaces of the main body.

17. The pouring device of claim 1, wherein the main body further comprises a releasable fastening mechanism attached to a first portion of the main body.

18. The pouring device of claim 17, wherein the closed configuration of the pouring device is maintained by releasably fastening, via the releasable fastening mechanism, the first portion of the main body to a second portion of the main body or to an exterior surface of the container.

19. The pouring device of claim 17, wherein the open configuration of the pouring device is maintained by releasably fastening, via the releasable fastening mechanism, the first portion of the main body to an exterior surface of the container.

20. The pouring device of claim 1, wherein at least a portion of the at least two walls and at least a portion of the at least one mounting part are capable of passing through the opening of the container, when the pouring device is in the closed configuration.

21. The pouring device of claim 1, wherein the main body defines a shape when the pouring device is in the open configuration, and wherein the opening of the container accommodates the shape defined by the main body.

22. The pouring device of claim 1, wherein the opening of the container is formed by at least partly removing a section of the container, and wherein at least a portion of the at least partly removed section of the container is capable of closing the conduit, when the pouring device is in the open configuration, thereby preventing the material from flowing through the conduit.

23. The pouring device of claim 1, wherein the main body further comprises a sealing mechanism, and wherein the inner bag is closed via sealing of the sealing mechanism when the pouring device is in the closed configuration.

24. The pouring device of claim 23, wherein the inner bag is opened via unsealing of the sealing mechanism when the pouring device is moved from the closed configuration to the open configuration.

25. The pouring device of claim 23, wherein the pouring device is biased towards the open configuration, and wherein the sealing mechanism maintains the closed configuration of the pouring device when the sealing mechanism is sealed.

26. The pouring device of claim 1, wherein the main body further comprises at least one extension part that extends from at least one of the at least two walls or the at least one attachment part, and wherein the at least one extension part is configured to extend into the inner bag.

27. The pouring device of claim 26, wherein the at least one extension part comprises a plurality of extension portions connected via at least one extension hinge.

28. The pouring device of claim 1, wherein the main body further comprises a closing mechanism, and wherein the closing mechanism substantially closes the conduit, when the pouring device is in the open configuration, thereby substantially preventing the material from flowing through the conduit.

29. The pouring device of claim 28, wherein the closing mechanism is positioned at a distance from the conduit, when the pouring device is in the closed configuration.

30. The pouring device of claim 28, wherein the closing mechanism comprises a closing hinge, and wherein the closing mechanism is folded along the closing hinge, when the pouring device is in the closed configuration.

31. The pouring device of claim 28, wherein the closing mechanism is an extendable and retractable closing mechanism, and wherein the closing mechanism is capable of extending angularly away from the conduit and is capable of retracting angularly towards the conduit, when the pouring device is in the open configuration.

32. The pouring device of claim 1, wherein the main body further comprises a closing mechanism positioned at an exit aperture of the conduit to maintain substantial closure of the conduit via the closing mechanism, when the pouring device is in the open configuration.

33. The pouring device of claim 1, wherein the main body further comprises at least one lip part, and wherein the at least one lip part extends from at least one of the at least two walls or the at least one attachment part, to the exterior of the container, when the pouring device is in the open configuration.

34. The pouring device of claim 33, wherein the at least one lip part comprises a plurality of lip portions connected via at least one lip hinge.

35. The pouring device of claim 34, wherein the plurality of lip portions face each other and lie substantially in a single plane, when the pouring device is in the closed configuration.

36. The pouring device of claim 33, wherein the at least one lip part is connected to the at least one of the at least two walls via at least one wall-lip hinge, such that the at least one lip part is capable of extending angularly away from the conduit and retracting angularly towards the conduit via the at least one wall-lip hinge.

37. The pouring device of claim 36, wherein the at least one lip part is biased towards being extended, towards being retracted, or towards both being extended and being retracted.

38. The pouring device of claim 36, wherein the at least one lip part, when retracted, substantially closes the conduit when the pouring device is in the open configuration, thereby substantially preventing the material from flowing through the conduit.

39. The pouring device of claim 36, wherein the at least one lip part either remains retracted via mechanical interconnection of the at least one lip part with a slit of the container or with a slit of another portion of the main body.

40. The pouring device of claim 36, wherein the main body further comprises a releasable fastening mechanism attached to the at least one lip part.

41. The pouring device of claim 40, wherein the at least one lip part remains extended by releasably fastening, via the releasable fastening mechanism, the at least one lip part to an exterior surface of the container.

42. The pouring device of claim 40, wherein the at least one lip part comprises a first lip portion and a second lip portion, wherein the at least one lip part remains retracted by releasably fastening, via the releasable fastening mechanism, the first lip portion to the second lip portion, at least one of the two walls, the at least one attachment part, or an exterior surface of the container.

43. A method of using a pouring device for pouring material from an inner bag placed within a container to an exterior of the container via an opening of the container, the pouring device being movable between a closed configuration and an open configuration different from the closed configuration, the method comprising:

providing a pouring device comprising:

a main body comprising:

at least two walls hingedly coupled to each other via at least two hinges, wherein the at least two walls move via the at least two hinges when the pouring device is moved from the closed configuration to the open configuration, and wherein a perimeter of a conduit is substantially defined by the at least two walls when the pouring device is in the open configuration; and at least one attachment part, wherein at least a portion of each attachment part is configured to be attached to a portion of the inner bag via an attachment mechanism, when the pouring device is in the open and closed configurations; and at least one mounting part connected to the main body; and attaching at least a portion of each mounting part to a portion of the container via at least one mounting mechanism or placing the at least a portion of each mounting part against the portion of the container, when the pouring device is in the open configuration;

wherein the material from the inner bag capable of flowing through the conduit to the exterior of the container via the opening of the container, when the pouring device is in the open configuration.

44. The method of claim 43, wherein the method further comprises attaching the at least a portion of each attachment part to the portion of the inner bag via the attachment mechanism, when the pouring device is in the open and closed configurations.

45. The method of claim 44, wherein the attachment mechanism is positioned at least partly along at least a portion of a width of the at least one attachment part, and wherein the portion of the inner bag is laterally adjacent to a portion of a seal area of the inner bag.

46. The method of claim 44, wherein the attachment mechanism is positioned on an exterior surface of the at least a portion of the at least one attachment part, and wherein the portion of the inner bag comprises an interior surface of the inner bag.

47. The method of claim 44, wherein the attachment mechanism is positioned on an interior surface of the at least a portion of the at least one attachment part, and wherein the portion of the inner bag comprises an exterior surface of the inner bag.

48. The method of claim 44, wherein the attachment mechanism is positioned at least partly along at least a portion of a width of the at least one attachment part, wherein the portion of the inner bag is a terminal edge of the inner bag, and wherein the terminal edge is an edge of the inner bag not exposed to an interior space of the inner bag.

49. The method of claim 43, wherein the at least one mounting mechanism is positioned on an upper surface of at least a portion of the at least one mounting part, and wherein the portion of the container comprises an interior surface of the container.

50. The method of claim 43, wherein the at least one mounting mechanism is positioned on a lower surface of at least a portion of the at least one mounting part, and wherein the portion of the container comprises an exterior surface of the container.

51. The method of claim 43, wherein the at least one mounting mechanism is positioned on a side surface of at least a portion of the at least one mounting part, and wherein the portion of the container comprises at least a portion of an edge of the opening of the container or another opening different than the opening of the container.

52. The method of claim 43, further comprising placing an upper surface of at least a portion of the at least one mounting part against the portion of the container, and wherein the portion of the container comprises an interior surface of the container.

53. The method of claim 43, further comprising placing a lower surface of at least a portion of the at least one mounting part against the portion of the container, and wherein the portion of the container comprises an exterior surface of the container.

54. The method of claim 43, further comprising placing a side surface of at least a portion of the at least one mounting part against the portion of the container, and wherein the portion of the container comprises at least a portion of an edge of the opening of the container or another opening different than the opening of the container.

55. The method of claim 43, wherein the at least two walls extend angularly away from each other via the at least two hinges, and wherein the method further comprises moving the pouring device from the closed configuration to the open configuration using the at least two hinges.

56. The method of claim 43, wherein the at least one attachment part comprises a plurality of attachment portions hingedly coupled via at least one attachment hinge, and wherein the method further comprises moving the pouring device from the closed configuration to the open configuration using the at least one attachment hinge.

57. The method of claim 43, further comprising applying inward pressure on opposing exterior surfaces of the main body to move the pouring device from the closed configuration to the open configuration.

58. The method of claim 43, wherein the main body further comprises a releasable fastening mechanism attached to a first portion of the main body.

59. The method of claim 58, further comprising maintaining the closed configuration of the pouring device by releasably fastening, via the releasable fastening mechanism, the first portion of the main body to a second portion of the main body or to an exterior surface of the container.

60. The method of claim 58, further comprising maintaining the open configuration of the pouring device by releasably fastening, via the releasable fastening mechanism, the first portion of the main body to an exterior surface of the container.

61. The method of claim 43, further comprising passing at least a portion of the at least two walls and at least a portion of the at least one mounting part through the opening of the container, when the pouring device is in the closed configuration.

62. The method of claim 43, wherein the main body defines a shape when the pouring device is in the open configuration, and wherein the method further comprises inserting the main body having the shape into at least a portion of the opening of the container whereby the shape of the main body is maintained by the at least a portion of the opening of the container.

63. The method of claim 43, further comprising forming the opening of the container by at least partly removing a section of the container.

64. The method of claim 63, further comprising closing the conduit via replacing at least a portion of the at least partly removed section of the container, when the pouring device is in the open configuration, thereby preventing the material from flowing through the conduit.

65. The method of claim 43, wherein the main body further comprises a sealing mechanism, and wherein the method further comprises closing the inner bag via sealing of the sealing mechanism when the pouring device is in the closed configuration.

66. The method of claim 65, further comprising opening the inner bag via unsealing of the sealing mechanism when the pouring device is moved from the closed configuration to the open configuration.

67. The method of claim 43, wherein the main body further comprises at least one extension part that extends from at least one of the at least two walls or the at least one attachment part, and wherein the method further comprises extending the at least one extension part into the inner bag to facilitate the flow of the material through the conduit or to provide rigidity to the inner bag.

68. The method of claim 67, wherein the at least one extension part comprises a plurality of extension portions connected via at least one extension hinge, and wherein the method further comprises moving the pouring device from the closed configuration to the open configuration using the at least one extension hinge.

69. The method of claim 43, wherein the main body further comprises a closing mechanism, and wherein the method further comprises substantially closing the conduit via the closing mechanism, when the pouring device is in the open configuration, thereby substantially preventing the material from flowing through the conduit.

70. The method of claim 69, wherein the closing mechanism comprises a closing hinge, and wherein the method further comprises folding the closing mechanism along the closing hinge, when the pouring device is in the closed configuration.

71. The method of claim 70, further comprising unfolding the folded closing mechanism when the pouring device is moved from the closed configuration to the open configuration.

72. The method of claim 69, wherein the closing mechanism is an extendable and retractable closing mechanism, and wherein the method further comprises extending the closing mechanism angularly away from the conduit and retracting the closing mechanism angularly towards the conduit, when the pouring device is in the open configuration.

73. The method of claim 43, wherein the main body further comprises a closing mechanism, and wherein the method further comprises positioning the closing mechanism at an exit aperture of the conduit to maintain substantial closure of the conduit via the closing mechanism, when the pouring device is in the open configuration.

74. The method of claim 43, wherein the main body further comprises at least one lip part extending from at least one of the at least two walls or the at least one attachment part, and wherein the method further comprises passing the at least one lip part through the opening of the container to the exterior of the container.

75. The method of claim 74, wherein the at least one lip part comprises a plurality of lip portions connected via at least one lip hinge, and wherein the method further comprises moving the pouring device from the closed configuration to the open configuration using the at least one lip hinge.

76. The method of claim 74, wherein the at least one lip part is connected to the at least one of the at least two walls via at least one wall-lip hinge, and wherein the method further comprises extending the at least one lip part angularly away from the conduit and retracting the at least one lip part angularly towards the conduit via the at least one wall-lip hinge.

77. The method of claim 76, further comprising substantially closing the conduit via the at least one lip part, when retracted, when the pouring device is in the open configuration, thereby substantially preventing the material from flowing through the conduit.

78. The method of claim 76, further comprising mechanically interconnecting the at least one lip part with a slit of the container or with a slit of another portion of the main body to maintain retraction of the at least one lip part.

79. The pouring device of claim 1, wherein the at least one attachment part is connected to the at least two walls.

80. The pouring device of claim 1, wherein the at least one attachment part is connected to the at least two walls via at least one attachment-wall hinge.

81. The pouring device of claim 28, wherein the closing mechanism is connected to the at least two walls.

82. The method of claim 43, wherein the at least one attachment part is connected to the at least two walls.

83. The method of claim 43, wherein the at least one attachment part is connected to the at least two walls via at least one attachment-wall hinge.

84. The pouring device of claim 1, wherein at least one of the at least two hinges is a wall hinge.

85. The pouring device of claim 3, wherein one of the at least one attachment hinge is one of the at least two hinges.

86. The method of claim 43, wherein at least one of the at least two hinges is a wall hinge.

87. The method of claim 56, wherein one of the at least one attachment hinge is one of the at least two hinges.

* * * * *